US009482221B2

(12) United States Patent
Kamitani et al.

(10) Patent No.: US 9,482,221 B2
(45) Date of Patent: Nov. 1, 2016

(54) GAS CONTROL APPARATUS

(71) Applicant: Murata Manufacturing Co., Ltd., Nagaokakyo-shi, Kyoto-fu (JP)

(72) Inventors: Gaku Kamitani, Nagaokakyo (JP); Atsuhiko Hirata, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 210 days.

(21) Appl. No.: 14/296,568

(22) Filed: Jun. 5, 2014

(65) Prior Publication Data

US 2014/0286795 A1 Sep. 25, 2014

Related U.S. Application Data

(63) Continuation of application No. PCT/JP2012/081453, filed on Dec. 5, 2012.

(30) Foreign Application Priority Data

Dec. 9, 2011 (JP) ..... 2011-270062

(51) Int. Cl.
*F04B 23/04* (2006.01)
*F04B 49/00* (2006.01)
(Continued)

(52) U.S. Cl.
CPC ..... *F04B 49/007* (2013.01); *F04B 39/10* (2013.01); *F04B 39/12* (2013.01); *F04B 43/046* (2013.01); *F04B 49/22* (2013.01)

(58) Field of Classification Search
CPC ..... F04B 49/007; F04B 49/22; F04B 39/12; F04B 39/10; F04B 39/43046; Y10T 137/7879; Y10T 137/7881
USPC ..... 417/62; 137/843, 845
See application file for complete search history.

(56) References Cited

U.S. PATENT DOCUMENTS 2,593,602 A * 4/1952 Taylor ..... F04B 49/007 417/252
3,908,360 A * 9/1975 Meyer ..... F02C 7/236 60/39.281

(Continued)

FOREIGN PATENT DOCUMENTS

JP 62-52291 U 4/1987
JP 04-020751 A 1/1992
WO 2011/145544 A1 11/2011

OTHER PUBLICATIONS

Official Communication issued in International Patent Application No. PCT/JP2012/081453, mailed on Mar. 12, 2013.

*Primary Examiner* — Charles Freay
(74) *Attorney, Agent, or Firm* — Keating & Bennett, LLP

(57) ABSTRACT

A gas control apparatus includes an upper housing to which a second piezoelectric pump is joined, a lower housing to which a first piezoelectric pump is joined, and a diaphragm. The upper housing includes a discharge hole through which gas is discharged. The lower housing includes introduction holes through which gas is introduced, an opening, a first valve seat, a second valve seat, and a third valve seat. The diaphragm is sandwiched between the upper housing and the lower housing, and is fixed to the upper housing and the lower housing so that the diaphragm contacts the first valve seat, the second valve seat, and the third valve seat. The diaphragm divides an inner space of the upper housing and the lower housing to define valve chests together with the upper housing and the lower housing.

16 Claims, 18 Drawing Sheets

(51) Int. Cl.

| | |
|---|---|
| ***F04B 39/10*** | (2006.01) |
| ***F04B 39/12*** | (2006.01) |
| ***F04B 43/04*** | (2006.01) |
| ***F04B 49/22*** | (2006.01) |

(56) References Cited

U.S. PATENT DOCUMENTS 5,094,085 A 3/1992 Irino
5,577,390 A * 11/1996 Kaido ..... F04B 25/005 236/1 EA
5,727,529 A * 3/1998 Tuckey ..... F02D 33/003 123/497
6,033,191 A * 3/2000 Kamper ..... F04B 43/043 417/322
6,196,806 B1 * 3/2001 Van Der Sluis .. F16H 61/66272 417/295
7,637,284 B1 * 12/2009 Feldmeier ..... F16K 11/20 137/883
2007/0077156 A1 * 4/2007 Orr ..... F04B 7/02 417/395
2010/0166585 A1 * 7/2010 Reichenbach ..... F04B 43/043 417/509
2012/0171062 A1 7/2012 Kodama et al.
2013/0178752 A1 * 7/2013 Kodama ..... A61B 5/0235 600/498
2015/0060012 A1 * 3/2015 Kamitani ..... F04B 43/046 165/59
2015/0233484 A1 * 8/2015 Maeda ..... F16K 15/185 251/335.2

* cited by examiner

GAS CONTROL APPARATUS

BACKGROUND OF THE INVENTION

1. Field of the Invention

The present invention relates to a gas control apparatus that performs gas control.

2. Description of the Related Art

Various types of gas control apparatuses that perform gas control by using a plurality of pumps have been devised. For example, Japanese Unexamined Utility Model Registration Application Publication No. 62-52291 discloses a two-stage vacuum pump capable of switching a state of connection between two pumps between a series connection and a parallel connection depending on the situation.

FIG. 17A is a diagram illustrating the flow of air in a two-stage vacuum pump 1 according to Japanese Unexamined Utility Model Registration Application Publication No. 62-52291 in the state in which a first-stage pump 4 and a second-stage pump 5 are connected in parallel. FIG. 17B is a diagram illustrating the flow of air in the two-stage vacuum pump 1 according to Japanese Unexamined Utility Model Registration Application Publication No. 62-52291 in the state in which the first-stage pump 4 and the second-stage pump 5 are connected in series. FIG. 18 is a sectional view of a directional control valve 9 illustrated in FIGS. 17A and 17B.

As illustrated in FIGS. 17A and 17B, the two-stage vacuum pump 1 includes a pump suction hole 2, a pump ejection hole 3, the first-stage pump 4, the second-stage pump 5, a check valve 7, and the directional control valve 9.

The inlet of the first-stage pump 4 is connected to the pump suction hole 2 and the check valve 7, and the outlet of the first-stage pump 4 is connected to an introduction hole 912 of the directional control valve 9. The inlet of the second-stage pump 5 is connected to a discharge hole 913 of the directional control valve 9, and is also connected to the pump suction hole 2 with the check valve 7 provided therebetween. The outlet of the second-stage pump 5 is connected to another discharge hole 914 of the directional control valve 9, and is also connected to the pump ejection hole 3. The check valve 7 allows air to flow from the pump suction hole 2 to the second-stage pump 5, but does not allow air to flow from the second-stage pump 5 to the pump suction hole 2.

As illustrated in FIG. 18, the directional control valve 9 includes a columnar casing 921 and a valve body 925 disposed in the casing 921. The casing 921 has the introduction hole 912 and discharge holes 913 and 914, valve chests 922 and 923, an introduction path 924 that connects the valve chests 922 and 923 to each other, and ring-shaped elastic members 932 and 934. The valve body 925 is accommodated in the valve chests 922 and 923 and the introduction path 924 such that the valve body 925 is slidable in an axial direction of the casing 921. The valve body 925 includes a rod 926 and disc-shaped valve portions 927 and 928 provided at the ends of the rod 926.

In the above-described structure, when a pressure difference between the pump suction hole 2 and the pump ejection hole 3 is smaller than or equal to a predetermined value, the valve body 925 of the directional control valve 9 slides toward the valve chest 922. Thus, a peripheral portion of the valve portion 927 comes into contact with the ring-shaped elastic member 934, so that the introduction hole 912 and the discharge hole 914 communicate with each other. As a result, the first-stage pump 4 and the second-stage pump 5 are connected in parallel as illustrated in FIG. 17A.

When the pressure difference between the pump suction hole 2 and the pump ejection hole 3 becomes greater than or equal to the predetermined value, the valve body 925 of the directional control valve 9 compresses a spring 929 and slides toward the valve chest 923. Thus, a peripheral portion of the valve portion 928 comes into contact with the ring-shaped elastic member 932, so that the introduction hole 912 and the discharge hole 913 communicate with each other. In addition, the check valve 7 is closed. As a result, the first-stage pump 4 and the second-stage pump 5 are connected in series as illustrated in FIG. 17B.

In the above-described valve structure of the directional control valve 9, to prevent air leakage through a gap between the valve body 925 and an inner wall of the casing 921 and allow the valve body 925 to slide smoothly, grease is generally applied between the valve body 925 and the inner wall of the casing 921. However, this method has a problem in that small particles of the grease (oil mist) are mixed into the air when the air flows through the casing 921, and clean air cannot be ejected from the pump ejection hole 3.

In addition, in the two-stage vacuum pump 1, the directional control valve 9 has a large and complex structure in which the valve body 925 is disposed in a slidable manner. Therefore, it is difficult to reduce the size, in particular, the height, of the two-stage vacuum pump 1. Furthermore, the performance (flow rate and pressure) of the pump decreases as the size of the two-stage vacuum pump 1 decreases. Therefore, there is a limit to the extent to which the size of the two-stage vacuum pump 1 having the structure according to the related art can be reduced while the performance of the pump is maintained.

SUMMARY OF THE INVENTION

Accordingly, preferred embodiments of the present invention provide a compact, low-profile gas control apparatus which is capable of switching a state of connection between a plurality of pumps between a series connection and a parallel connection and with which mixture of impurities into gas is prevented.

A gas control apparatus according to a preferred embodiment of the present invention includes a housing including an introduction hole and a discharge hole; a first check valve and a second check valve that are disposed between the introduction hole and the discharge hole and are configured to block flow of gas from the discharge hole to the introduction hole; a first pump including a suction hole connected to the introduction hole and an ejection hole connected to the second check valve; a second pump including a suction hole connected to the first check valve and an ejection hole connected to the discharge hole; and a directional control valve disposed between the ejection hole of the first pump and the suction hole of the second pump; wherein the first check valve, the second check valve, the first pump, the second pump, and the directional control valve are located in the housing; the directional control valve includes a first diaphragm, first and second valve chests partitioned from each other by the first diaphragm, and a first valve seat disposed in the first valve chest; the first diaphragm includes a region in which the first diaphragm contacts the first valve seat; the first valve seat includes an opening connected to the suction hole of the second pump; the first valve chest is connected to the ejection hole of the first pump; and the directional control valve is configured to switch a state of connection between the first pump ejection hole and the suction hole of the second pump between connected and disconnected states in accordance with a difference between forces applied to both principal surfaces of the first diaphragm.

Preferably, the first check valve includes a second diaphragm, third and fourth valve chests partitioned from each other by the second diaphragm, and a second valve seat disposed in the third valve chest, the second diaphragm includes a region in which the second diaphragm contacts an end portion of the second valve seat and a hole that extends through a portion of the region, and the third valve chest is connected to the introduction hole, and the fourth valve chest is connected to the suction hole of the second pump.

Preferably, the second check valve includes a third diaphragm, fifth and sixth valve chests partitioned from each other by the third diaphragm, and a third valve seat disposed in the fifth valve chest, the third diaphragm includes a region in which the third diaphragm contacts an end portion of the third valve seat and a hole that extends through a portion of the region, and the fifth valve chest is connected to the ejection hole of the first pump, and the sixth valve chest is connected to the discharge hole.

In this structure, the discharge hole is connected to a reservoir that stores gas. With this structure, when the first and second pumps start to operate, gas in the fourth valve chest is sucked by the second pump and ejected into the reservoir. Accordingly, the pressure in the fourth valve chest becomes lower than the outside pressure, and the pressure in the reservoir becomes higher than the outside pressure. At the same time, gas outside the housing is sucked through the introduction hole by the first pump, and is ejected from the ejection hole of the first pump. Accordingly, pressures in the first valve chest and the fifth valve chest become higher than the outside pressure.

As a result, in the first check valve, the pressure in the fourth valve chest becomes lower than the pressure in the third valve chest. Therefore, the second diaphragm separates from the second valve seat, so that the fourth valve chest and the third valve chest communicate with each other. In the second check valve, the pressure in the fifth valve chest becomes higher than the pressure in the sixth valve chest. Therefore, the third diaphragm separates from the third valve seat, so that the fifth valve chest and the sixth valve chest communicate with each other.

In the directional control valve, a force that is equal to the product of the pressure applied to one principal surface of the first diaphragm in the second valve chest and the area thereof is greater than a force that is equal to the product of the pressures applied to the other principal surface of the first diaphragm in the first valve chest and the opening and the areas thereof. Therefore, the first diaphragm contacts the first valve seat, so that the first valve chest and the second valve chest are blocked from each other.

Thus, in the gas control apparatus having the above-described structure, the first pump and the second pump are connected in parallel when the first and second pumps start to operate.

When gas is introduced into the reservoir while the first pump and the second pump are connected in parallel, the pressure in the reservoir gradually increases. Accordingly, the pressures in the sixth valve chest which communicates with the reservoir, the first valve chest, the fourth valve chest, and the opening also gradually increase.

Consequently, in the directional control valve, the force that is equal to the product of the pressures applied to the other principal surface of the first diaphragm in the first valve chest and the opening and the areas thereof becomes higher than the force that is equal to the product of the pressure applied to the one principal surface of the first diaphragm in the second valve chest and the area thereof. Therefore, the first diaphragm separates from the first valve seat, so that the first valve chest and the opening communicate with each other.

In the second check valve, the pressure in the sixth valve chest becomes higher than the pressure in the fifth valve chest. Therefore, the third diaphragm comes into contact with the third valve seat, so that the fifth valve chest and the sixth valve chest are blocked from each other.

In the first check valve, the pressure in the fourth valve chest becomes higher than the pressure in the third valve chest. Therefore, the second diaphragm comes into contact with the second valve seat, so that the fourth valve chest and the third valve chest are blocked from each other.

Thus, in the gas control apparatus having the above-described structure, when the pressure in the reservoir increases, the first pump and the second pump become connected in series.

With the above-described gas control apparatus, the first and second pumps are connected in parallel while the pressure in the reservoir is low, and the state of connection between the first and second pumps switches from the parallel connection to the series connection when the pressure in the reservoir becomes high. When two pumps are connected in parallel, the maximum pump pressure of the gas control apparatus is equal to that in the case where only one of the two pumps having a higher maximum pump pressure is connected to the reservoir, but the maximum flow rate is equal to the sum of the maximum pump flow rates of the individual pumps. In contrast, when the two pumps are connected in series, the maximum ejection flow rate of the gas control apparatus is equal to that in the case where only one of the two pumps having a higher maximum pump flow rate is connected to the reservoir, but the maximum pump pressure is equal to the sum of the maximum pump pressures of the individual pumps.

Therefore, with this structure, a high flow rate is achieved at a low pump pressure when the first and second pumps are connected in parallel. In addition, a high pump pressure is achieved at a low flow rate when the first and second pumps are connected in series. Thus, both of these characteristics are realized.

Furthermore, the state of connection between the first and second pumps is gradually switched from the parallel connection to the series connection in accordance with the displacements of the diaphragms caused by the pressure variation in each region of the gas control apparatus. Therefore, the pressure and the flow rate do not change suddenly, and the transition of the pump characteristics occurs smoothly.

Furthermore, with this structure, since the diaphragms are flexible and come into tight contact with the respective valve seats, gas leakage does not occur. In addition, since no sliding occurs when the diaphragms come into contact with or separate from the respective valve seats, it is not necessary to apply grease between the diaphragms and the housing. Therefore, mixture of impurities into gas is prevented.

Furthermore, the gas control apparatus has a simple structure in which the diaphragms are fixed to the housing. Therefore, the size, in particular, height, is significantly reduced and the characteristics (flow rate and pressure) of each pump are maintained.

Thus, with the above-described structure, a compact, low-profile gas control apparatus which is capable of switching a state of connection between a plurality of pumps between a series connection and a parallel connection and with which mixture of impurities into gas is prevented is provided.

Preferably, the housing further includes a vent, the second valve chest of the directional control valve is connected to the vent, and a pressure in the second valve chest is an atmospheric pressure.

In the directional control valve having this structure, the force equal to the product of the pressure in the second valve chest, which is the atmospheric pressure, and the area is applied to one principal surface of the first diaphragm.

Preferably, the first, second, and third diaphragms are defined by a single common diaphragm.

With this structure, the number of diaphragms preferably is one. Therefore, the manufacturing cost of the gas control apparatus is significantly reduced.

According to another preferred embodiment of the present invention, a gas control apparatus includes a housing including an introduction hole and a discharge hole; a diaphragm configured to divide an inner space of the housing to define a first region that communicates with the introduction hole, a second region that communicates with the discharge hole, a third region, and a fourth region in the housing; a first pump including a first pump chamber, a first suction hole, and a first ejection hole, the first suction hole and the first ejection hole communicating with each other through the first pump chamber, the first suction hole communicating with the first region, and the first ejection hole communicating with the third region; and a second pump including a second pump chamber, a second suction hole, and a second ejection hole, the second suction hole and the second ejection hole communicating with each other through the second pump chamber, the second suction hole communicating with the fourth region, and the second ejection hole communicating with the second region; wherein the diaphragm is fixed to the housing so that when a pressure in the third region is higher than a pressure in the second region and a pressure in the fourth region is lower than a pressure in the first region while the first and second pumps are in operation, the third region and the fourth region are blocked from each other, the second region and the third region communicate with each other, and the first region and the fourth region communicate with each other, and when the pressure in the third region is lower than the pressure in the second region and the pressure in the fourth region is higher than the pressure in the first region while the first and second pumps are in operation, the second region and the third region are blocked from each other, the first region and the fourth region are blocked from each other, and the third region and the fourth region communicate with each other.

In this structure, the discharge hole is connected to a reservoir that stores gas. With this structure, when the first and second pumps start to operate, gas in the fourth region is sucked by the second pump and ejected into the second region. Accordingly, the pressure in the fourth region becomes lower than the outside pressure, and the pressure in the second region becomes higher than the outside pressure. At the same time, gas outside the housing is sucked from the introduction hole through the first region by the first pump, and ejected into the third region. Accordingly, the pressure in the first region becomes equal to the outside pressure, and the pressure in the third region becomes higher than the outside pressure.

As a result, when the pressure in the fourth region becomes lower than the pressure in the first region, the diaphragm causes the first region and the fourth region to communicate with each other. When the pressure in the third region becomes higher than the pressure in the second region, the diaphragm causes the second region and the third region to communicate with each other. The diaphragm blocks the third region and the fourth region from each other.

Thus, in the gas control apparatus having the above-described structure, the first and second pumps are connected in parallel when the first and second pumps start to operate.

When gas is introduced into the reservoir while the first pump and the second pump are connected in parallel, the pressure in the reservoir gradually increases. Accordingly, the pressures in the second region which communicates with the reservoir, the fourth region, and the third region also gradually increase.

Accordingly, the diaphragm causes the third region and the fourth region to communicate with each other.

When the pressure in the second region becomes higher than the pressure in the third region, the diaphragm blocks the second region and the third region from each other.

When the pressure in the fourth region becomes higher than the pressure in the first region, the diaphragm blocks the first region and the fourth region from each other.

Thus, in the gas control apparatus having the above-described structure, when the pressure in the reservoir increases, the first pump and the second pump become connected in series.

With this structure, the first and second pumps are connected in parallel while the pressure in the reservoir is low, and the state of connection between the first and second pumps switches from the parallel connection to the series connection when the pressure in the reservoir becomes high. When two pumps are connected in parallel, the maximum pump pressure of the gas control apparatus is equal to that in the case where only one of the two pumps having a higher maximum pump pressure is connected to the reservoir, but the maximum flow rate is equal to the sum of the maximum pump flow rates of the individual pumps. In contrast, when the two pumps are connected in series, the maximum ejection flow rate of the gas control apparatus is equal to that in the case where only one of the two pumps having a higher maximum pump flow rate is connected to the reservoir, but the maximum pump pressure is equal to the sum of the maximum pump pressures of the individual pumps.

Therefore, with this structure, a high flow rate is achieved at a low pump pressure when the first and second pumps are connected in parallel. In addition, a high pump pressure is achieved at a low flow rate when the first and second pumps are connected in series. Thus, both of these characteristics are realized.

Furthermore, the state of connection between the first and second pumps is gradually switched from the parallel connection to the series connection in accordance with the displacements of the diaphragm caused by the pressure variation in each region of the gas control apparatus. Therefore, the pressure and the flow rate do not change suddenly, and the transition of the pump characteristics occurs smoothly.

Furthermore, with this structure, since the diaphragm is flexible and comes into tight contact with the housing, gas leakage does not occur. In addition, since no sliding occurs when the diaphragm comes into contact with or separates from the housing, it is not necessary to apply grease between the diaphragm and the housing. Therefore, mixture of impurities into gas is prevented.

Furthermore, the gas control apparatus has a simple structure in which the diaphragm is fixed to the housing.

Therefore, the size, in particular, height, is reduced and the characteristics (flow rate and pressure) of each pump are maintained.

Thus, with the above-described structure, a compact, low-profile gas control apparatus which is capable of switching a state of connection between a plurality of pumps between a series connection and a parallel connection and with which mixture of impurities into gas is prevented is provided.

Preferably, the housing includes an opening that communicates with the fourth region, a first valve seat that projects from a region around the opening toward the diaphragm in the third region, a second valve seat that projects toward the diaphragm in the first region, and a third valve seat that projects toward the diaphragm in the third region, the diaphragm is fixed to the housing so that the diaphragm contacts the first valve seat, the second valve seat, and the third valve seat, and the diaphragm includes a hole in a portion of a region in which the diaphragm contacts the second valve seat and a hole in a portion of a region in which the diaphragm contacts the third valve seat.

Preferably, the diaphragm comes into contact with or separates from the first valve seat in accordance with a pressure difference between the first region and the third region to switch between open and closed states, comes into contact with or separates from the second valve seat in accordance with a pressure difference between the first region and the fourth region to switch between open and closed states, and comes into contact with or separates from the third valve seat in accordance with a pressure difference between the second region and the third region to switch between open and closed states.

With this structure, when the pressure in the third region is higher than the pressure in the second region and the pressure in the fourth region is lower than the pressure in the first region, the diaphragm contacts the first valve seat to close the opening, separates from the second valve seat to open the corresponding hole, and separates from the third valve seat to open the corresponding hole.

When the pressure in the third region is lower than the pressure in the second region and the pressure in the fourth region is higher than the pressure in the first region, the diaphragm separates from the first valve seat to open the opening, contacts the second valve seat to close the corresponding hole, and contacts the third valve seat to close the corresponding hole.

Preferably, the diaphragm defines, together with the housing, a first check valve that opens and closes in accordance with the pressure difference between the first region and the fourth region, a second check valve that opens and closes in accordance with the pressure difference between the second region and the third region, and a directional control valve that opens and closes in accordance with the pressure difference between the first region and the third region, the first check valve prevents gas from flowing from the fourth region to the first region, the second check valve prevents gas from flowing from the second region to the third region, and while the first and second pumps are in operation, the directional control valve blocks the third region and the fourth region from each other when the pressure in the third region is higher than the pressure in the second region and the pressure in the fourth region is lower than the pressure in the first region, and connects the third region and the fourth region to each other when the pressure in the third region is lower than the pressure in the second region and the pressure in the fourth region is higher than the pressure in the first region.

In this structure, the gas control apparatus includes the first pump, the second pump, the first check valve, the second check valve, the directional control valve, the introduction hole, and the discharge hole. The first suction hole of the first pump is connected to the introduction hole and the first check valve, and the first ejection hole of the first pump is connected to the second check valve and the directional control valve. The second suction hole of the second pump is connected to the first check valve and the directional control valve, and the second ejection hole of the second pump is connected to the discharge hole and the second check valve.

The first check valve allows gas to flow from the introduction hole to the second pump, but does not allow gas to flow from the second pump or the directional control valve to the introduction hole. The second check valve allows gas to flow from the first pump to the discharge hole, but does not allow gas to flow from the discharge hole to the first pump or the directional control valve.

Preferably, the first, second, and third valve seats are configured and arranged on the housing so as to pre-press the diaphragm.

With this structure, the first, second, and third valve seats are in contact with the diaphragm so as to apply a tension (hereinafter referred to as a pre-pressing force) to the diaphragm. Therefore, when the pressure in the third region is higher than the pressure in the second region and the pressure in the fourth region is lower than the pressure in the first region, the state in which the diaphragm is in contact with the valve seat to close the valve is maintained due to the pre-pressure.

Preferably, the housing includes a first housing including the introduction hole and a second housing including the discharge hole, and the diaphragm is preferably defined by an elastic member, and is sandwiched by the first housing and the second housing from both sides.

With this structure, the diaphragm is pressed and sandwiched by the first and second housings. As a result, the adhesion between the diaphragm and the first and second housings is increased. Consequently, gas is prevented from leaking to the outside through the gaps between the diaphragm and the first and second housings.

Therefore, in this structure, no grease for improving the sealing performance is required, and oil mist of the grease does not mix into gas when the gas passes through the housing. Consequently, with this structure, clean gas is discharged from the discharge hole.

Preferably, the discharge hole is connected to a reservoir, and the gas control apparatus further includes a quick exhaust portion that communicates with the discharge hole and that is capable of quickly discharging gas when the first and second pumps stop to operate, the gas having been introduced into the reservoir by an operation of the first and second pumps.

With this structure, gas in the reservoir is quickly exhausted through the second region. Therefore, with this structure, the gas is quickly exhausted from the reservoir after the reservoir is filled with compressed air.

According to a further preferred embodiment of the present invention, a gas control apparatus includes a housing including an introduction hole and a discharge hole; a diaphragm that divides an inner space of the housing to define a first region that communicates with the introduction hole, a second region that communicates with the discharge hole, a third region, a $2t^{th}$ (t is an integer from 2 to n−1) region, a $2t+1^{th}$ region, and a $2n^{th}$ (n is an integer of 3 or more) region in the housing; a first pump including a first pump chamber, a first suction hole, and a first ejection hole, the first suction hole and the first ejection hole communicating with each other through the first pump chamber, the first suction hole communicating with the first region, and the first ejection hole communicating with the third region; at $t^{th}$ pump having a $t^{th}$ pump chamber, a $t^{th}$ suction hole, and a $t^{th}$ ejection hole, the $t^{th}$ suction hole and the $t^{th}$ ejection hole communicating with each other through the $t^{th}$ pump chamber, the $t^{th}$ suction hole communicating with the $2t^{th}$ region, and the $t^{th}$ ejection hole communicating with the $2t+1^{th}$ region; and an $n^{th}$ pump having an $n^{th}$ pump chamber, an $n^{th}$ suction hole, and an $n^{th}$ ejection hole, the $n^{th}$ suction hole and the $n^{th}$ ejection hole communicating with each other through the $n^{th}$ pump chamber, the $n^{th}$ suction hole communicating with the 2 $n^{th}$ region, and the $n^{th}$ ejection hole communicating with the second region; wherein the n pumps are connected to each other, the diaphragm is fixed to the housing so that when pressures in the third region and the $2t+1^{th}$ region are higher than a pressure in the second region and pressures in the $2t^{th}$ region and the $2n^{th}$ region are lower than a pressure in the first region while the first, $t^{th}$, and $n^{th}$ pumps are in operation, the third region and the $2t+1^{th}$ region are blocked from the $2t^{th}$ region and the $2n^{th}$ region, respectively, each of the third region and the $2t+1^{th}$ region communicates with the second region, and each of the $2t^{th}$ region and the $2n^{th}$ region communicates with the first region, and when the pressures in the third region and the $2t+1^{th}$ region are lower than the pressure in the second region and the pressures in the $2t^{th}$ region and the $2n^{th}$ region are higher than the pressure in the first region while the first, $t^{th}$, and $n^{th}$ pumps are in operation, each of the third region and the $2t+1^{th}$ region is blocked from the second region, each of the $2t^{th}$ region and the $2n^{th}$ region is blocked from the first region, and the third region and the $2t+1^{th}$ region communicate with the $2t^{th}$ region and the $2n^{th}$ region, respectively.

With this structure, the discharge hole is connected to a reservoir that stores gas. With this structure, the n pumps are connected in parallel while the pressure in the reservoir is low, and become connected in series when the pressure in the reservoir becomes high.

Therefore, also in this structure, a high flow rate is achieved at a low pump pressure when the first, $t^{th}$, and $n^{th}$ pumps are connected in parallel. In addition, a high pump pressure is achieved at a low flow rate when the first, $t^{th}$, and $n^{th}$ pumps are connected in series. Thus, both of these characteristics are realized.

Furthermore, the state of connection between the first, $t^{th}$, and $n^{th}$ pumps is gradually switched from the parallel connection to the series connection in accordance with the displacements of the diaphragm caused by the pressure variation in each region of the gas control apparatus. Therefore, the high-flow-rate characteristics smoothly switch to the high-pump-pressure characteristics.

Furthermore, with this structure, since the diaphragm is flexible and comes into tight contact with the housing, gas leakage does not occur. In addition, since no sliding occurs when the diaphragm comes into contact with or separates from the housing, it is not necessary to apply grease between the diaphragm and the housing. Therefore, mixture of impurities into gas is prevented.

Furthermore, the gas control apparatus has a simple structure in which the diaphragm is fixed to the housing. Therefore, the size, in particular, height, is reduced and the performance (flow rate and pressure) of each pump are maintained.

Accordingly, with this structure, effects similar to those achieved by other preferred embodiments of the present invention described above are achieved.

According to various preferred embodiments of the present invention, a compact, low-profile gas control apparatus which is capable of switching a state of connection between a plurality of pumps between a series connection and a parallel connection and with which mixture of impurities into gas is prevented is provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

First Preferred Embodiment

A gas control apparatus 100 according to a first preferred embodiment of the present invention will now be described.

Figure 1:
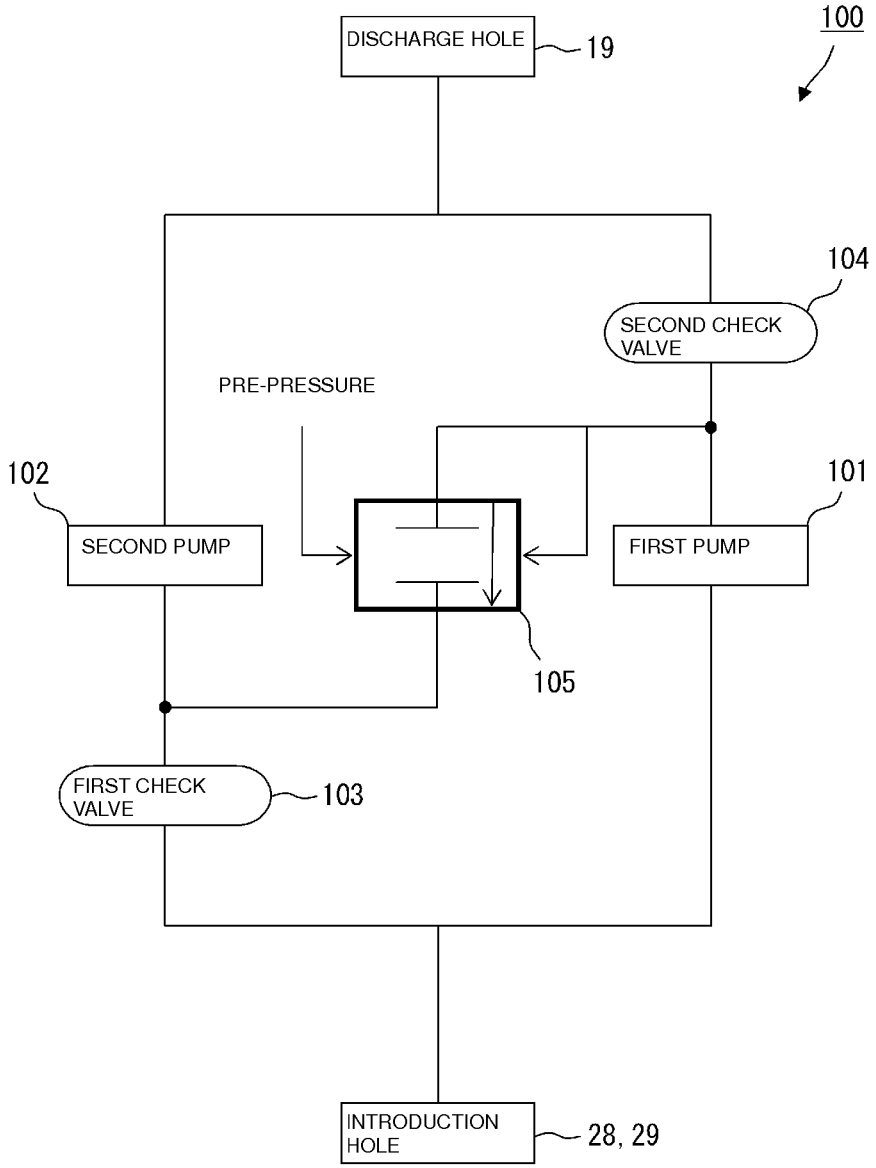
FIG. 1 is a block diagram illustrating the manner in which components included in a gas control apparatus 100 according to a first preferred embodiment of the present invention are connected.
Figure 2:
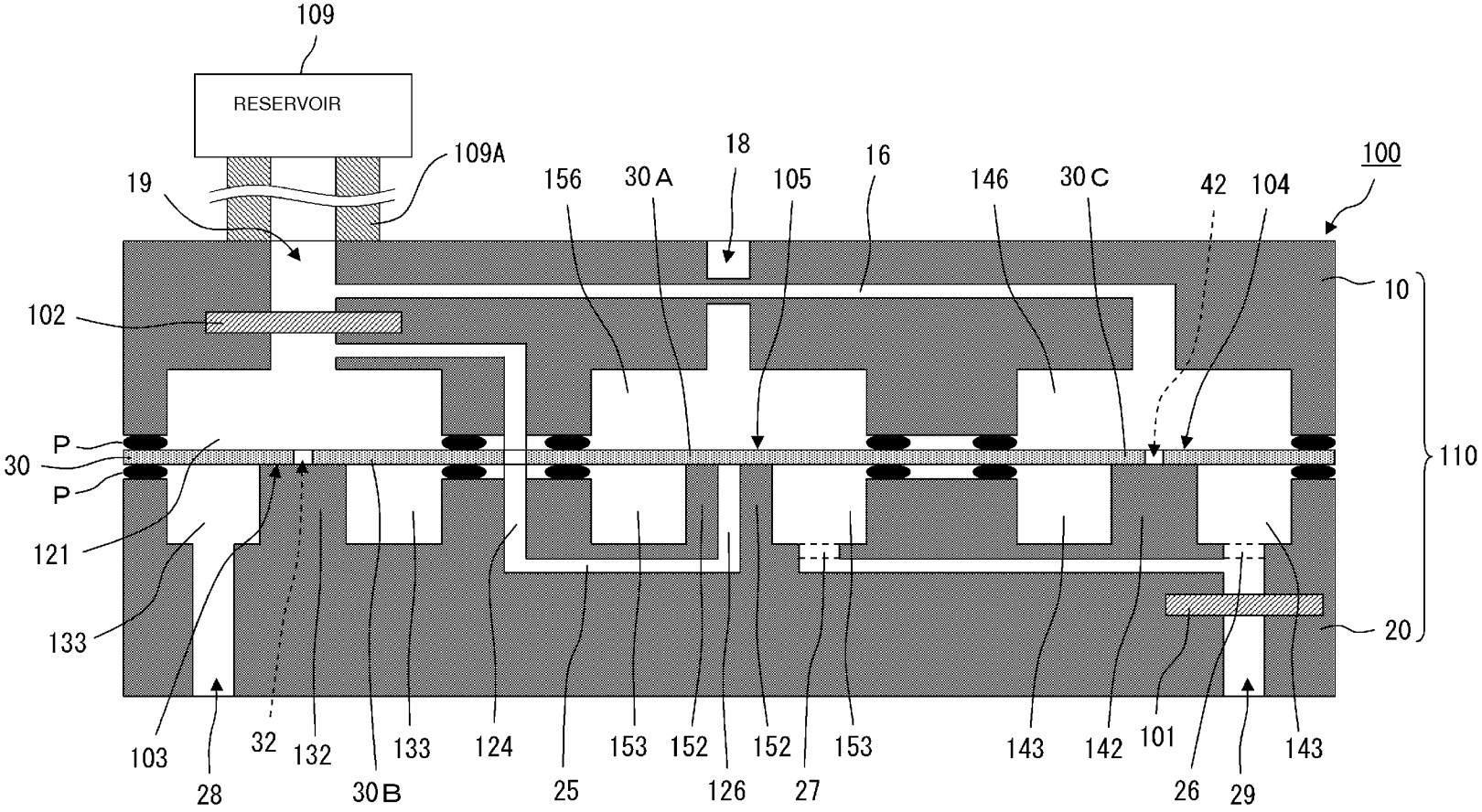
FIG. 2 is a conceptual diagram of the gas control apparatus 100 according to the first preferred embodiment of the present invention.
Figure 3:
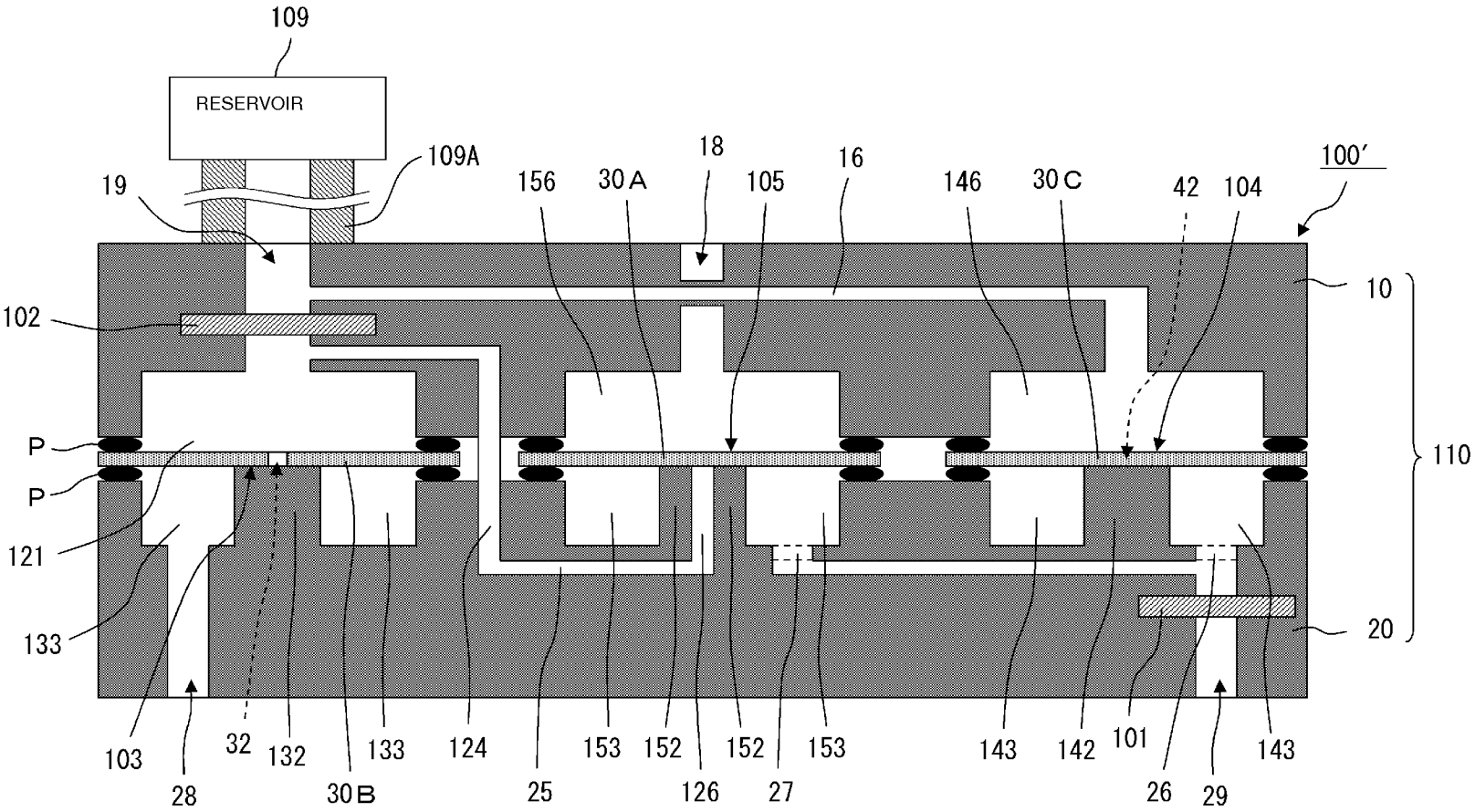
FIG. 3 is a conceptual diagram of a gas control apparatus 100' according to a modification of the first preferred embodiment of the present invention.
Figure 4:
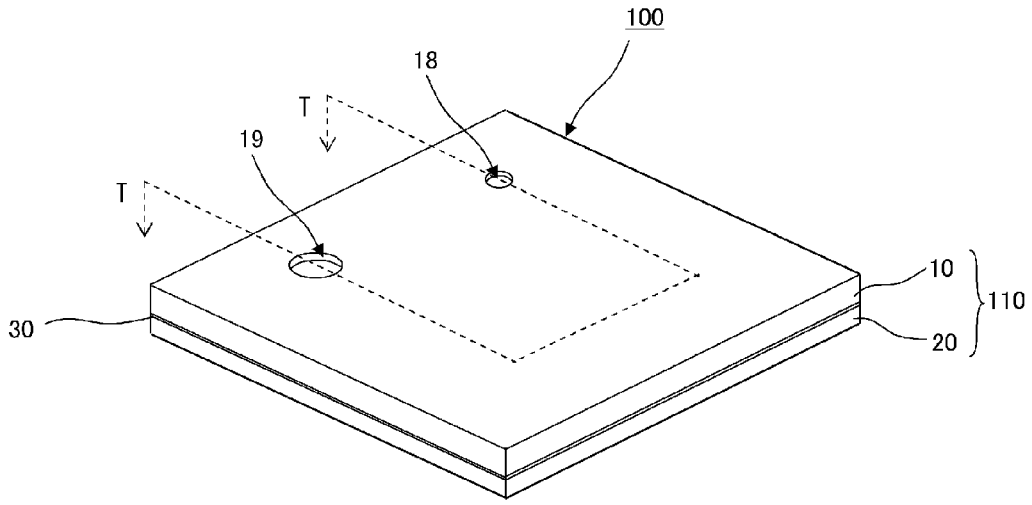
FIG. 4 is an external perspective view of the gas control apparatus 100 according to the first preferred embodiment of the present invention.
Figure 5:
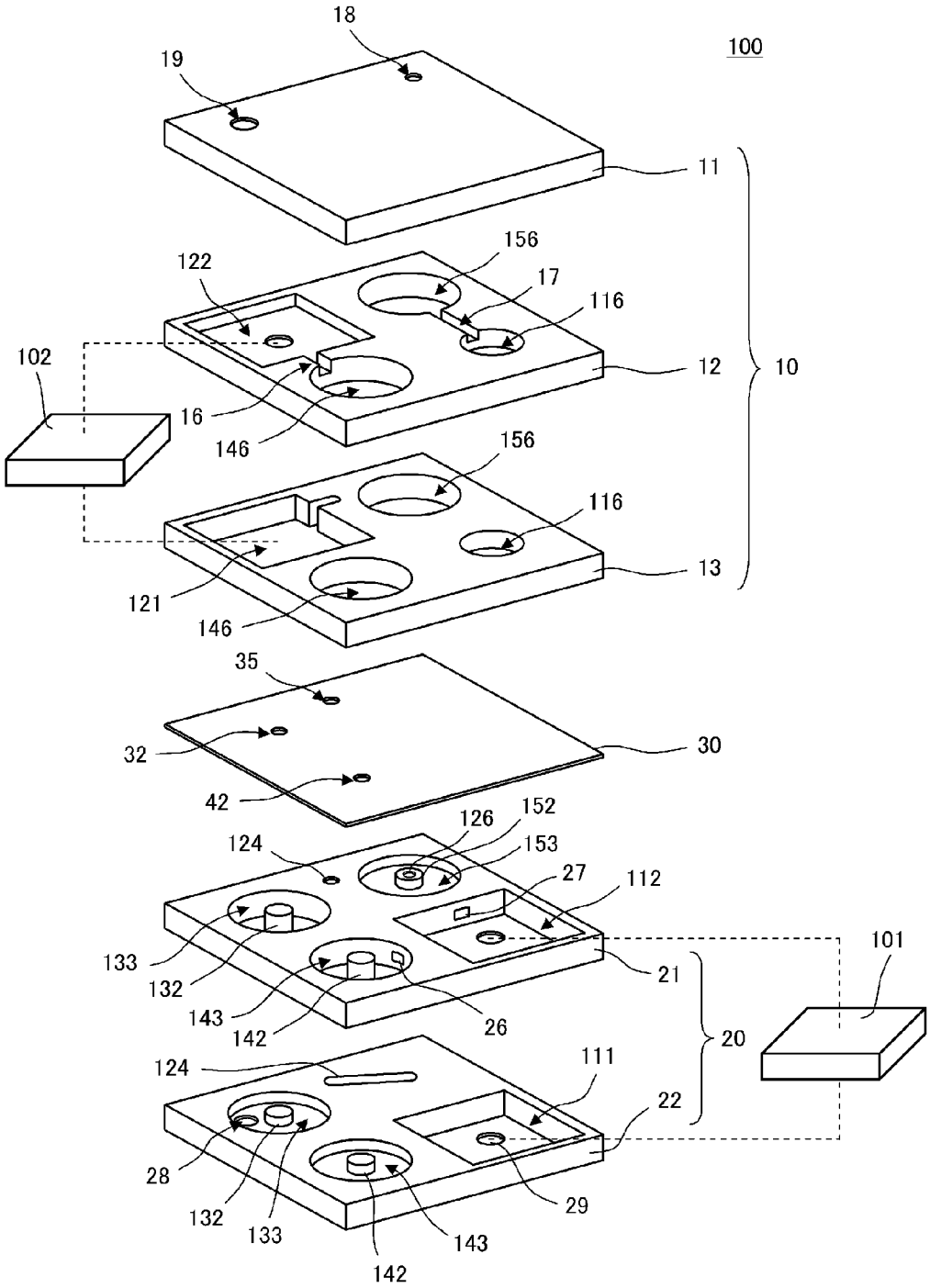
FIG. 5 is an exploded perspective view of the gas control apparatus 100 according to the first preferred embodiment of the present invention.
Figure 6:
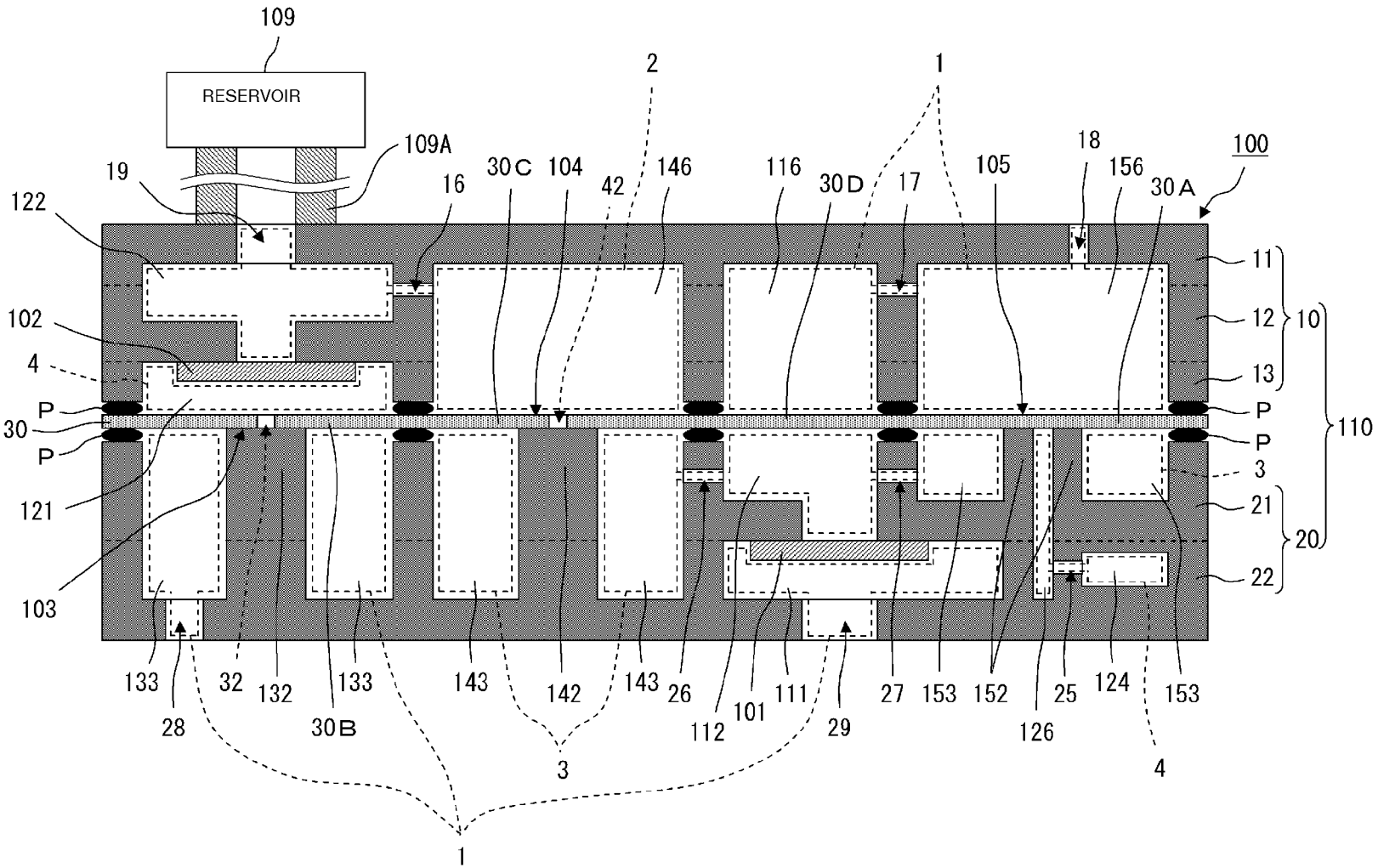
FIG. 6 is a sectional view of the gas control apparatus 100 according to the first preferred embodiment of the present invention taken along line T-T in FIG. 4.

FIG. 1 is a block diagram illustrating the manner in which a first piezoelectric pump 101, a second piezoelectric pump 102, a first check valve 103, a second check valve 104, a directional control valve 105, introduction holes 28 and 29, and a discharge hole 19, which are included in the gas control apparatus 100 according to the first preferred embodiment of the present invention, are connected. FIG. 2 is a conceptual diagram of the gas control apparatus 100. FIG. 3 is a conceptual diagram of a gas control apparatus 100'. FIG. 4 is an external perspective view of the gas control apparatus 100. FIG. 5 is an exploded perspective view of the gas control apparatus 100. FIG. 6 is a sectional view of the gas control apparatus 100 taken along line T-T in FIG. 4. First, the schematic structure of the gas control apparatus 100 will be described with reference to FIGS. 1 and 2.

A "first housing" corresponds to a lower housing 20, a "second housing" corresponds to an upper housing 10, and a "housing" corresponds to the lower housing 20 and the upper housing 10. A "first valve chest" corresponds to a first valve chest 153, a "second valve chest" corresponds to a second valve chest 156, a "third valve chest" corresponds to a third valve chest 133, a "fourth valve chest" corresponds to a fourth valve chest 121, a "fifth valve chest" corresponds to a fifth valve chest 143, and a "sixth valve chest" corresponds to a sixth valve chest 146.

A "first region" corresponds to a first region 1 including the second valve chest 156, the third valve chest 133, an eighth valve chest 116, a communication hole 17, and an introduction chamber 111. A "second region" corresponds to a second region 2 including a discharge chamber 122, a communication hole 16, and a sixth valve chest 146. A "third region" corresponds to a third region 3 including the first valve chest 153, a seventh valve chest 112, a communication hole 26, the fifth valve chest 143, and a communication hole 27. A "fourth region" corresponds to a fourth region 4 including a communication path 124, a communication hole 25, and the fourth valve chest 121.

A "first valve seat" corresponds to a first valve seat 152, a "second valve seat" corresponds to a second valve seat 132, and a "third valve seat" corresponds to a third valve seat 142.

As illustrated in FIGS. 1 and 2, the gas control apparatus 100 includes a housing 110 including the introduction holes 28 and 29 and the discharge hole 19, the first piezoelectric pump 101, the second piezoelectric pump 102, the first check valve 103, the second check valve 104, and the directional control valve 105. The discharge hole 19 is connected to, for example a reservoir.

The first piezoelectric pump 101 includes a suction hole connected to the introduction hole 29 and an ejection hole connected to the second check valve 104.

The second piezoelectric pump 102 includes a suction hole connected to the first check valve 103 and an ejection hole connected to the discharge hole 19.

The directional control valve 105 is disposed between the ejection hole of the first piezoelectric pump 101 and the suction hole of the second piezoelectric pump 102. The directional control valve 105 includes a first diaphragm 30A, the first and second valve chests 153 and 156 partitioned from each other by the first diaphragm 30A, and the first valve seat 152 disposed in the first valve chest 153 so as to project toward the first diaphragm 30A.

The first diaphragm 30A includes a region in which the first diaphragm 30A contacts the first valve seat 152. The first valve seat 152 includes an opening 126 connected to the suction hole of the second piezoelectric pump 102. In the directional control valve 105, the first valve chest 153 is connected to the ejection hole of the first piezoelectric pump 101. In the directional control valve 105, the second valve chest 156 is connected to, for example, a vent 18 that is open to the atmosphere. The first valve seat 152 is provided on the housing 110 so as to pre-press the first diaphragm 30A.

The directional control valve 105 switches the state of connection between the ejection hole of the first piezoelectric pump 101 and the suction hole of the second piezoelectric pump 102 between connected and disconnected states in accordance with the difference between forces applied to both principal surfaces of the first diaphragm 30A.

The first check valve 103 is disposed between the introduction hole 28 and the suction hole of the second piezoelectric pump 102. The first check valve 103 allows gas to flow from the introduction hole 28 to the suction hole of the second piezoelectric pump 102, but does not allow gas to flow from the suction hole of the second piezoelectric pump 102 to the introduction hole 28.

The first check valve 103 includes a second diaphragm 30B, the third and fourth valve chests 133 and 121 partitioned from each other by the second diaphragm 30B, and the second valve seat 132 disposed in the third valve chest 133 so as to project toward the second diaphragm 30B. The second diaphragm 30B includes a region in which the second diaphragm 30B contacts an end portion of the second valve seat 132 in the projecting direction thereof, and a through hole 32 is provided in a portion of that region. The third valve chest 133 is connected to the introduction hole 28, and the fourth valve chest 121 is connected to the suction hole of the second piezoelectric pump 102. The second valve seat 132 is configured and arranged on the housing 110 so as to pre-press the second diaphragm 30B.

The first check valve 103 switches the state of connection between the introduction hole 28 and the suction hole of the second piezoelectric pump 102 between connected and disconnected states in accordance with the difference between forces applied to both principal surfaces of the second diaphragm 30B.

The second check valve 104 is disposed between the ejection hole of the first piezoelectric pump 101 and the discharge hole 19. The second check valve 104 allows gas to flow from the ejection hole of the first piezoelectric pump 101 to the discharge hole 19, but does not allow gas to flow from the discharge hole 19 to the ejection hole of the first piezoelectric pump 101.

The second check valve 104 includes a third diaphragm 30C, the fifth and sixth valve chests 143 and 146 partitioned from each other by the third diaphragm 30C, and the third valve seat 142 disposed in the fifth valve chest 143 so as to project toward the third diaphragm 30C. The third diaphragm 30C includes a region in which the third diaphragm 30C contacts an end portion of the third valve seat 142 in the projecting direction thereof, and a through hole 42 is provided in a portion of that region. The fifth valve chest 143 is connected to the ejection hole of the first piezoelectric pump 101, and the sixth valve chest 146 is connected to the discharge hole 19. The third valve seat 142 is provided on the housing 110 so as to pre-press the third diaphragm 30C.

The second check valve 104 switches the state of connection between the ejection hole of the first piezoelectric pump 101 and the discharge hole 19 between connected and disconnected states in accordance with the difference between forces applied to both principal surfaces of the third diaphragm 30C.

In this preferred embodiment, the first diaphragm 30A, the second diaphragm 30B, and the third diaphragm 30C are preferably defined by a single common diaphragm 30. However, they are not limited to this. As illustrated in FIG. 3, the first diaphragm 30A, the second diaphragm 30B, and the third diaphragm 30C may instead be defined by three diaphragms, for example.

The structure of the gas control apparatus 100 will now be described with reference to FIGS. 4 to 6.

As illustrated in FIGS. 4 to 6, the gas control apparatus 100 includes the housing 110, the first check valve 103, the second check valve 104, the directional control valve 105, the first piezoelectric pump 101, and the second piezoelectric pump 102.

The first check valve 103, the second check valve 104, and the directional control valve 105 are preferably defined by the housing 110 and the diaphragm 30. In other words, the first to sixth valve chests 153, 156, 133, 121, 143, and 146, the seventh valve chest 112, and the eighth valve chest 116 are preferably defined by the housing 110 and the diaphragm 30.

The first valve seat 152, the second valve seat 132, and the third valve seat 142 are preferably defined by the common housing 110. The diaphragm 30 includes the first diaphragm 30A, the second diaphragm 30B, the third diaphragm 30C, and a fourth diaphragm 30D. In other words, the first diaphragm 30A, the second diaphragm 30B, the third diaphragm 30C, and the fourth diaphragm 30D are preferably defined by the single common diaphragm 30.

The housing 110 includes the upper housing 10 and the lower housing 20. The upper housing 10 and the lower housing 20 are preferably made of, for example, a resin. As illustrated in FIGS. 5 and 6, the second piezoelectric pump 102, which will be described in detail below, is disposed in the upper housing 10, and the first piezoelectric pump 101, which will be described in detail below, is disposed in the lower housing 20.

In FIG. 6, to improve visibility of the structure of the gas control apparatus 100, the upper housing 10 is divided into three layers, which are a lid portion 11, an intermediate portion 12, and a first clamping portion 13, and the lower housing 20 is divided into two layers, which are a second clamping portion 21 and a bottom plate 22. In FIG. 6, boundaries between the layers are shown by dotted lines.

As illustrated in FIG. 6, the upper housing 10 includes the discharge hole 19 which is connected to a rubber tube 109A of a reservoir 109 to allow air in the housing 110 to flow into the reservoir 109 through the rubber tube 109A; the discharge chamber 122 which preferably has a rectangular or substantially rectangular parallelepiped shape and which communicates with the discharge hole 19; the communication hole 16 that connects the discharge chamber 122 and the sixth valve chest 146 to each other; the vent 18 which communicates with the outside of the upper housing 10; and the communication hole 17 which connects the second valve chest 156 and the eighth valve chest 116, which will be described below, to each other. The reservoir 109 preferably is, for example, a beach ball, an inflatable boat, a toy such as a balloon doll, or a tire.

The lower housing 20 includes the introduction holes 28 and 29 through which air outside the lower housing 20 flows into the housing 110; the introduction chamber 111 which preferably has a rectangular or substantially rectangular parallelepiped shape, which communicates with the introduction hole 29, and which accommodates the first piezoelectric pump 101; the communication hole 26 which connects the fifth valve chest 143 and the seventh valve chest 112 to each other; the communication hole 27 which connects the first valve chest 153 and the seventh valve chest 112 to each other; the opening 126; the communication path 124 which communicates with the fourth valve chest 121 through a hole 32 in the diaphragm 30; the communication hole 25 that connects the opening 126 and the communication path 124 to each other; the first valve seat 152 which preferably has a cylindrical or substantially cylindrical shape and which projects toward the diaphragm 30 in a region around the opening 126; and the second and third valve seats 132 and 142 which project toward the diaphragm 30. The first valve seat 152, the second valve seat 132, and the third valve seat 142 are provided on the lower housing 20 so as to pre-press the diaphragm 30.

The diaphragm 30 preferably is defined by a plate-shaped thin film, and is flexible. The diaphragm 30 is sandwiched by the upper housing 10 and the lower housing 20 from both sides with packing P provided between the diaphragm 30 and each of the upper housing 10 and the lower housing 20. The diaphragm 30 is fixed to the upper housing 10 and the lower housing 20 such that the diaphragm 30 is in contact with the first valve seat 152, the second valve seat 132, and the third valve seat 142.

Thus, the diaphragm 30 divides the inner space of the upper housing 10 and the lower housing 20 to define, together with the upper housing 10 and the lower housing 20, the first valve chest 153 which preferably has a ring-shaped configuration, the second valve chest 156 which preferably has a columnar shape, the third valve chest 133 which preferably has a ring-shaped configuration, the fourth valve chest 121 which preferably has a rectangular or substantially rectangular parallelepiped shape, the fifth valve chest 143 which preferably has a ring-shaped configuration, the sixth valve chest 146 which preferably has a columnar shape, the seventh valve chest 112 which preferably has a rectangular or substantially rectangular parallelepiped shape, and the eighth valve chest 116 which preferably has a columnar shape.

The diaphragm 30 is preferably defined by an elastic member made of, for example, ethylene propylene rubber or silicone rubber. The diaphragm 30 is pressed and sandwiched by the upper housing 10 and the lower housing 20 from both sides at a temperature higher than a normal temperature. Therefore, the diaphragm 30 is pressed by the upper housing 10 and the lower housing 20, and adhesion between contact portions of the diaphragm 30 and the upper housing 10 and that between contact portions of the diaphragm 30 and the lower housing 20 are increased. Consequently, leakage of air to the outside through gaps between the diaphragm 30 and the upper housing 10 and between the diaphragm 30 and the lower housing 20 is prevented or significantly reduced.

The diaphragm 30A between the first valve chest 153 and the second valve chest 156 is in contact with the cylindrical first valve seat 152, and defines the directional control valve 105 together with the upper housing 10 and the lower housing 20. The diaphragm 30B between the third valve chest 133 and the fourth valve chest 121 is in contact with the second valve seat 132, and defines the first check valve 103 together with the upper housing 10 and the lower housing 20. The diaphragm 30C between the fifth valve chest 143 and the sixth valve chest 146 is in contact with the third valve seat 142, and forms the second check valve 104 together with the upper housing 10 and the lower housing 20.

The seventh valve chest 112 communicates with the fifth valve chest 143 through the communication hole 26, and also communicates with the first valve chest 153 through the communication hole 27. The eighth valve chest 116 communicates with the second valve chest 156 through the communication hole 17, and also communicates with the outside of the upper housing through the vent 18. Therefore, the air pressures in the second valve chest 156 and the eighth valve chest 116 are constantly the atmospheric pressure.

Figure 7:
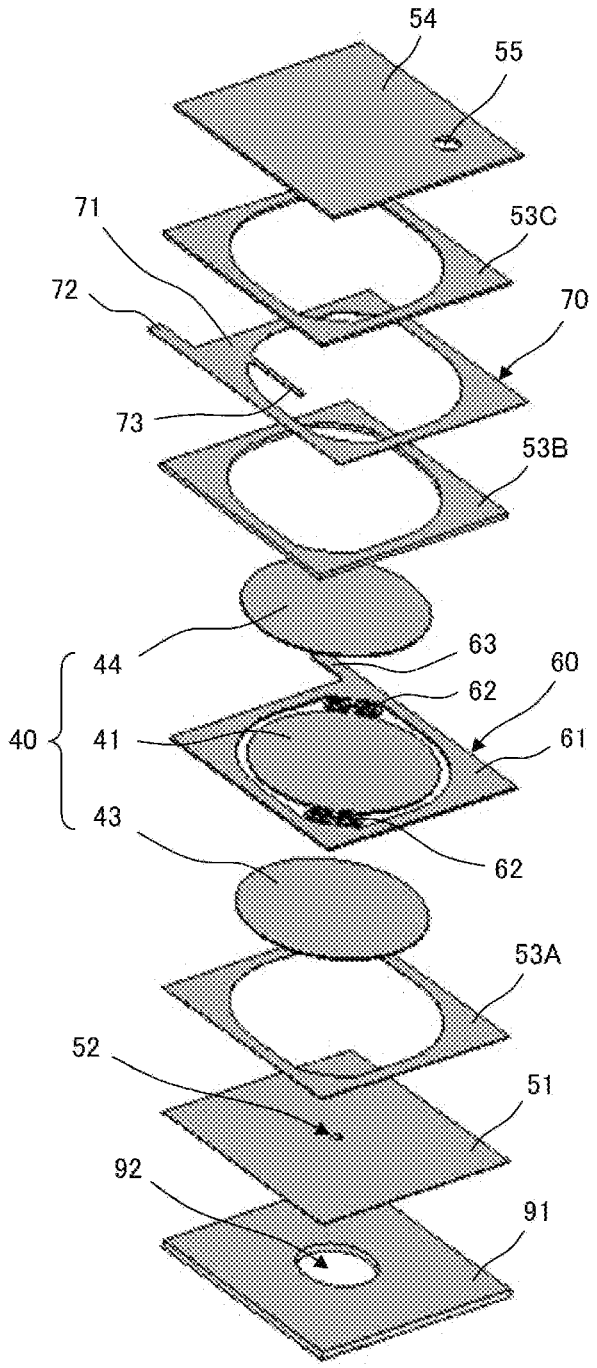
FIG. 7 is an exploded perspective view of a first piezoelectric pump 101 according to the first preferred embodiment of the present invention.
Figure 8:
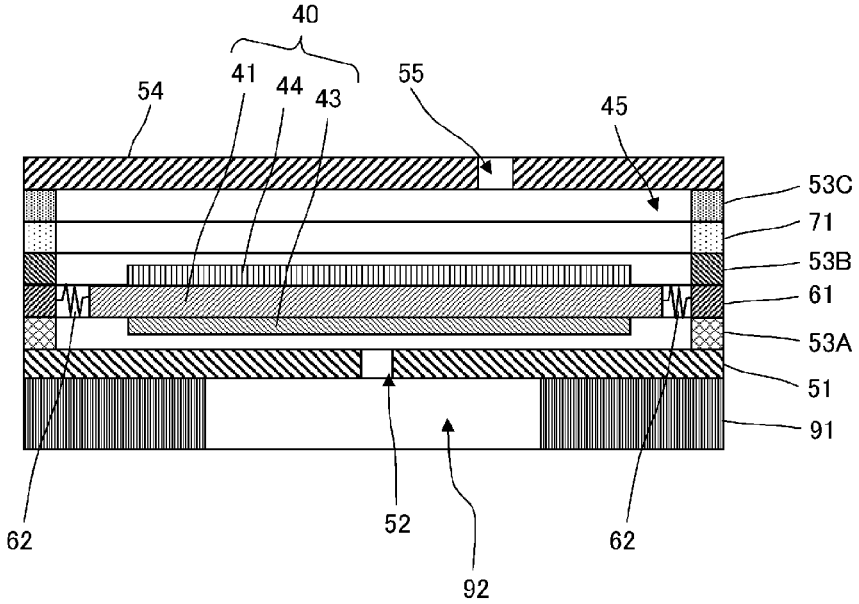
FIG. 8 is a sectional view of the main part of the first piezoelectric pump 101 according to the first preferred embodiment of the present invention.

The structure of the first piezoelectric pump 101 and the second piezoelectric pump 102 will now be described in detail. FIG. 7 is an exploded perspective view of the first piezoelectric pump 101 included in the gas control apparatus 100 according to the first preferred embodiment of the present invention. FIG. 8 is a sectional view of the main portion of the first piezoelectric pump 101 illustrated in FIG. 7. The first piezoelectric pump 101 includes a substrate 91, a flexible plate 51, a spacer 53A, a reinforcing plate 43, a vibrating plate unit 60, a piezoelectric element 44, a spacer 53B, an electrode conduction plate 70, a spacer 53C, and a lid portion 54, which are successively stacked on top of each other.

The structure of the second piezoelectric pump 102 is preferably the same as that of the first piezoelectric pump 101, and description thereof will thus be omitted.

The piezoelectric element 44 is bonded to the top surface of a disc-shaped vibrating plate 41, and the reinforcing plate 43 is bonded to the bottom surface of the vibrating plate 41. The vibrating plate 41, the piezoelectric element 44, and the reinforcing plate 43 define an actuator 40. The piezoelectric element 44 is preferably made of, for example, a lead zirconate titanate ceramic. In the case where the vibrating plate 41 is defined by a metal plate having a coefficient of linear expansion higher than those of the piezoelectric element and the reinforcing plate 43 and thermal hardening is performed when they are bonded together, warping of the entire body is prevented and an appropriate compressive stress remains in the piezoelectric element 44, so that cracking of the piezoelectric element 44 is prevented. For example, the vibrating plate 41 may be made of a material having a high coefficient of linear expansion, such as phosphor bronze (C5210) or stainless steel SUS301, and the reinforcing plate 43 may be made of 42 nickel, 36 nickel, or stainless steel SUS430. The thickness of the spacer 53B may be equal to or slightly larger than the thickness of the piezoelectric element 44.

The vibrating plate 41, the piezoelectric element 44, and the reinforcing plate 43 may instead be arranged in the order of the piezoelectric element 44, the reinforcing plate 43, and the vibrating plate 41 from the top. In this case, the coefficients of linear expansion are adjusted by switching the materials of the reinforcing plate 43 and the vibrating plate 41 so that an appropriate compressive stress remains in the piezoelectric element 44.

A frame plate 61 is provided around the vibrating plate 41, and the vibrating plate 41 is connected to the frame plate 61 with connecting portions 62. Each connecting portion 62 is, for example, ring-shaped and has an elastic structure with a small spring constant.

Thus, the vibrating plate 41 is softly supported by two connecting portions 62 at two positions on the frame plate 61, so that bending vibration of the vibrating plate 41 is hardly attenuated. In other words, the peripheral portion (and the central portion, of course) of the actuator 40 is substantially not restrained.

The spacer 53A is configured so that the actuator 40 is held with a predetermined gap provided between the actuator and the flexible plate 51. The frame plate 61 includes an external terminal 63 to provide an electrical connection.

The vibrating plate 41, the frame plate 61, the connecting portions 62, and the external terminal 63, which preferably are punched out of a metal plate, form the vibrating plate unit 60.

The spacer 53B, which is preferably made of a resin, is bonded to the top surface of the frame plate 61. The thickness of the spacer 53B preferably is the same as or slightly larger than the thickness of the piezoelectric element 44. The spacer 53B defines and serves as a portion of a pump housing 80, and electrically insulates the electrode conduction plate 70, which will be described below, and the vibrating plate unit 60 from each other.

The electrode conduction plate 70, which preferably is made of a metal, is bonded to the spacer 53B. The electrode conduction plate 70 includes a frame portion 71, which preferably includes a circular or substantially circular opening, an internal terminal 73 that projects into the opening, and an external terminal 72 that projects outward.

The tip of the internal terminal 73 is soldered onto a surface of the piezoelectric element 44. Vibration of the internal terminal 73 is significantly reduced or prevented when the tip of the internal terminal 73 is soldered at a position corresponding to a node of bending vibration of the actuator 40.

The spacer 53C, which preferably is made of a resin, is bonded to the electrode conduction plate 70. The thickness of the spacer 53C is equal or substantially equal to the thickness of the piezoelectric element 44. The spacer 53C is configured to prevent the soldered portion of the internal terminal 73 from coming into contact with the lid portion 54 when the actuator is vibrated. The spacer 53C also prevents a reduction in vibration amplitude due to air resistance, which occurs when a surface of the piezoelectric element 44 becomes too close to the lid portion 54. Therefore, the thickness of the spacer 53C preferably is equal or substantially equal to the thickness of the piezoelectric element 44, as described above.

The lid portion 54 has an ejection hole 55, and is disposed on the top portion of the spacer 53C so as to cover a region around the actuator 40. The ejection hole 55 is configured to release the positive pressure in the pump housing including the lid portion 54, and may be located at any position of the lid portion 54 as long as this function is achieved.

A suction hole 52 is preferably located at the center of the flexible plate 51. The spacer 53A, whose thickness preferably is equal or substantially equal to the sum of the thickness of the reinforcing plate 43 and about several tens of micrometers, for example, is inserted between the flexible plate 51 and the vibrating plate unit 60. The vibrating plate 41 is not restrained by the frame plate 61, but is affected to some extent by the restraint imposed by the connecting portions 62 (spring terminals). Therefore, in the case where the spacer 53A is inserted, when the pressure in the ejection-hole-55-side region is low, a large space is provided between the flexible plate 51 and the vibrating plate 41, and the ejection flow rate is increased. When the spacer 53A is inserted and the pressure in the ejection-hole-55-side region is high, the connecting portions 62 (spring terminals) are bent so that the gap between opposing portions of the actuator 40 and the flexible plate 51 is automatically reduced, and the operation is performed with a high pressure.

Although the connecting portions 62 preferably are provided at two locations in the example illustrated in FIG. 7, they may instead be provided at three or more locations, for example.

The substrate 91, which includes a cylindrical or substantially cylindrical opening 92 at the center thereof, is provided below the flexible plate 51. A portion of the flexible plate 51 is exposed at the opening 92 of the substrate 91. As a result of the pressure variation caused by the vibration of the actuator 40, the circular or substantially circular exposed portion is capable of vibration at the same or substantially the same frequency as that of the actuator 40. With the above-described structure of the flexible plate 51 and the substrate 91, a portion of the flexible plate 51 at or near the center of a region where the flexible plate 51 faces the actuator serves as a movable portion capable of performing bending vibration, and a peripheral portion of the flexible plate 51 defines and serves as a fixed portion that is substantially restrained. The circular or substantially circular movable portion is designed so that the natural frequency thereof is equal to or slightly lower than the driving frequency of the actuator 40.

Therefore, the exposed portion of the flexible plate including the suction hole 52 at the center vibrates at a large amplitude in response to the vibration of the actuator 40. When the vibration of the flexible plate 51 has a phase lag (phase lag of, for example, 90°) relative to the vibration of the actuator 40, variation in the thickness of the gap space between the flexible plate 51 and the actuator 40 is significantly increased. Consequently, the performance of the pump is improved.

The operation of the gas control apparatus 100 in an air introducing process will now be described.

Figure 9:
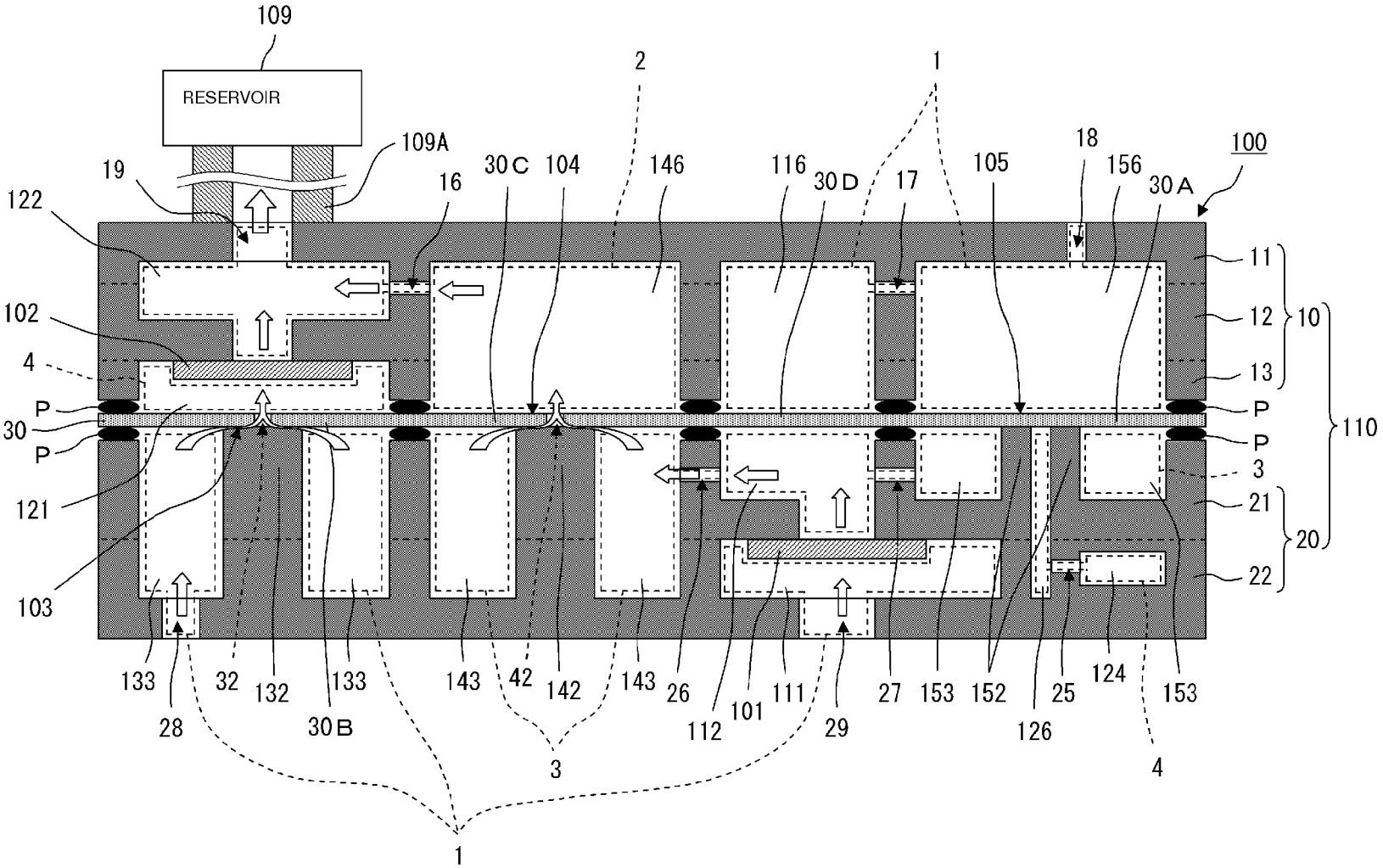
FIG. 9 is a sectional view illustrating the flow of air in the gas control apparatus 100 in the state in which the first piezoelectric pump 101 and a second piezoelectric pump 102 are connected in parallel according to the first preferred embodiment of the present invention.
Figure 10:
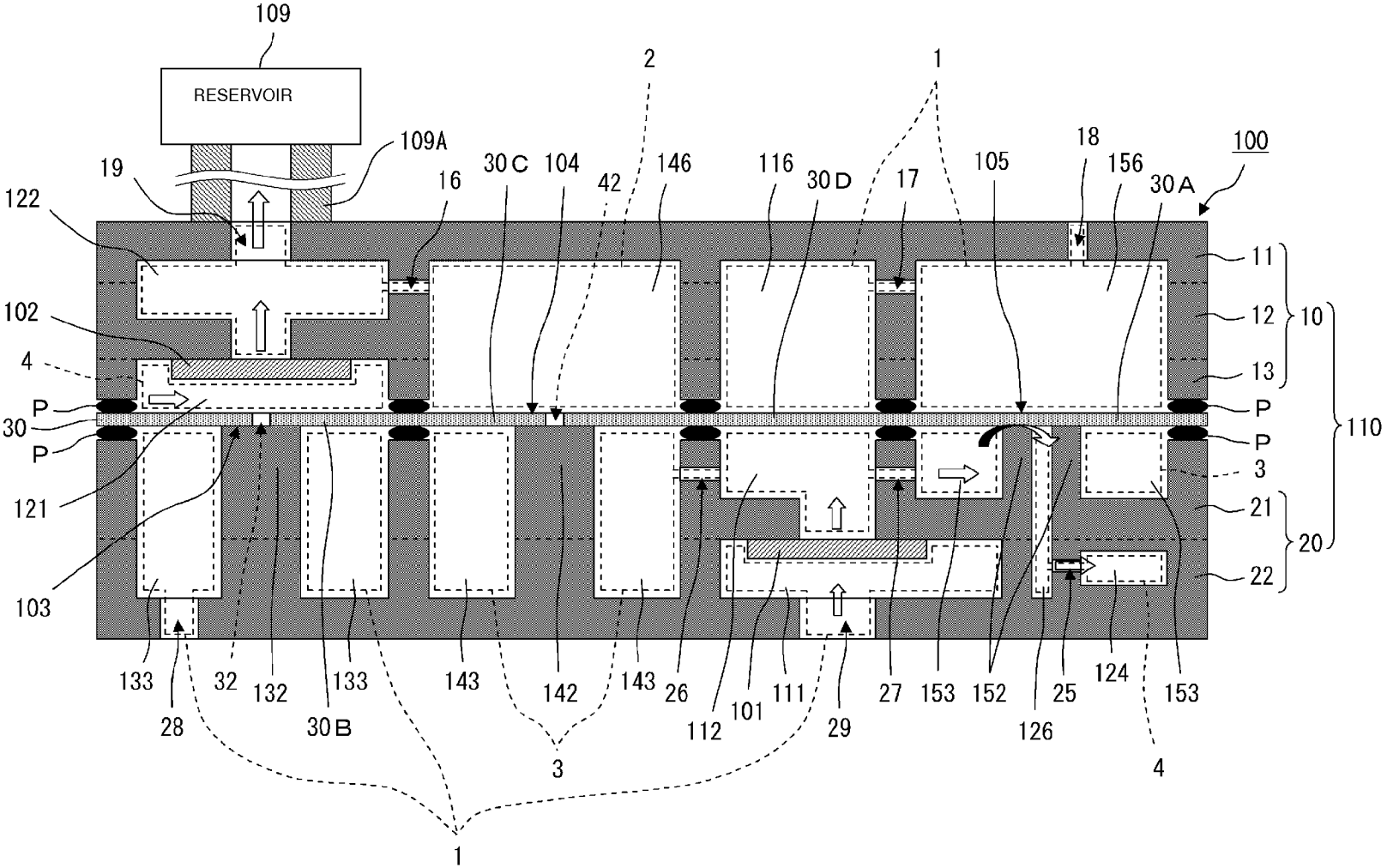
FIG. 10 is a sectional view illustrating the flow of air in the gas control apparatus 100 in the state in which the first piezoelectric pump 101 and the second piezoelectric pump 102 are connected in series according to the first preferred embodiment of the present invention.

FIG. 9 is a sectional view illustrating the flow of air in the gas control apparatus 100 in the state in which the first piezoelectric pump 101 and the second piezoelectric pump 102 illustrated in FIG. 6 are connected in parallel. FIG. 10 is a sectional view illustrating the flow of air in the gas control apparatus 100 in the state in which the first piezoelectric pump 101 and the second piezoelectric pump 102 illustrated in FIG. 6 are connected in series.

In the gas control apparatus 100, when the first piezoelectric pump 101 and the second piezoelectric pump 102 start to operate, the first piezoelectric pump 101 and the second piezoelectric pump 102 are connected in parallel. Then, when the pressure in the reservoir 109 exceeds a certain pressure (for example, 15 kPa), the first piezoelectric pump 101 and the second piezoelectric pump 102 become connected in series.

More specifically, the gas control apparatus 100 activates the first piezoelectric pump 101 and the second piezoelectric pump 102 to start introducing air into the reservoir 109.

When the first piezoelectric pump 101 and the second piezoelectric pump 102 are activated, the air in the fourth valve chest 121 is sucked into a pump chamber 45 of the second piezoelectric pump 102, and is discharged from the pump chamber 45 of the second piezoelectric pump 102 into the reservoir 109 through the discharge chamber 122.

Accordingly, the pressure in the fourth valve chest 121 decreases, and the pressure in the reservoir 109 becomes higher than the outside pressure. At the same time, air outside the housing 110 is sucked into a pump chamber 45 of the first piezoelectric pump 101 through the introduction hole 29 and the introduction chamber 111, and is ejected from the pump chamber of the first piezoelectric pump 101 into the seventh valve chest 112. Accordingly, the pressures in the seventh valve chest 112, the fifth valve chest 143, and the first valve chest 153 become higher than the outside pressure.

As a result, in the first check valve 103, the pressure in the fourth valve chest 121 becomes lower than the pressure in the third valve chest 133. Therefore, the second diaphragm 30B separates from the second valve seat 132, so that the third valve chest 133 and the fourth valve chest 121 communicate with each other through the hole 32 in the second diaphragm 30B.

In the second check valve 104, the pressure in the fifth valve chest 143 becomes higher than the pressure in the sixth valve chest 146. Therefore, the third diaphragm 30C separates from the third valve seat 142, so that the fifth valve chest 143 and the sixth valve chest 146 communicate with each other through the hole 42 in the third diaphragm 30C.

In the directional control valve 105, a force that is equal to the product of the pressure applied to one principal surface of the first diaphragm 30A in the second valve chest 156 and the area thereof is greater than a force that is equal to the product of the pressures applied to the other principal surface of the first diaphragm 30A in the first valve chest 153 and the opening 126 and the areas thereof. Therefore, the first diaphragm 30A contacts the first valve seat 152, so that the first valve chest 153 and the second valve chest 156 are blocked from each other.

Thus, in the gas control apparatus 100, when the first piezoelectric pump 101 and the second piezoelectric pump 102 are activated, the first piezoelectric pump 101 and the second piezoelectric pump 102 are connected in parallel (see FIG. 9).

When the parallel connection is established, the outside air is sucked into the pump chamber 45 of the first piezoelectric pump 101 through the introduction hole 29 and the introduction chamber 111, is ejected from the pump chamber 45 of the first piezoelectric pump 101 into the seventh valve chest 112, and flows into the discharge chamber 122 through the fifth valve chest 143 and the sixth valve chest 146. In addition, the outside air is sucked into the pump chamber 45 of the second piezoelectric pump 102 through the introduction hole 28, the third valve chest 133, and the fourth valve chest 121, and is ejected from the pump chamber 45 of the second piezoelectric pump 102 into the discharge chamber 122. Then, the merged air in the discharge chamber 122 is discharged into the reservoir 109 from the discharge hole 19. As the air is introduced into the reservoir 109 while the first piezoelectric pump 101 and the second piezoelectric pump 102 are connected in parallel, the pressure (air pressure) in the reservoir 109 gradually increases.

Accordingly, the pressure in the sixth valve chest 146, which communicates with the reservoir 109, also gradually increases, and the pressures in the first valve chest 153, the fourth valve chest 121, and the opening 126 also gradually increase.

As a result, in the second check valve 104, the pressure in the fifth valve chest 143 becomes higher than the pressure in the sixth valve chest 146. Therefore, the third diaphragm 30C comes into contact with the third valve seat 142, so that the fifth valve chest 143 and the sixth valve chest 146 are blocked from each other.

In the directional control valve 105, the force that is equal to the product of the pressures applied to the other principal surface of the first diaphragm 30A in the first valve chest 153 and the opening 126 and the areas thereof becomes higher than the force that is equal to the product of the pressure applied to the one principal surface of the first diaphragm 30A in the second valve chest 156 and the area thereof. Therefore, the first diaphragm 30A separates from the first valve seat 153, so that the first valve chest 153 and the opening 126 communicate with each other.

In the directional control valve 105, when the pressure in the second valve chest 156 is P1, the pressure in the opening 126 is P2, the pressure in the first valve chest 153 is P0, the area of a portion of the first diaphragm 30A that faces the second valve chest 156 is A1, the area of a portion of the first diaphragm 30A that faces the opening 126 is A2, and the area of a portion of the first diaphragm 30A that faces the first valve chest 153 is A0, the directional control valve 105 opens when the relationship $P1 \times A1 > P0 \times A0 + P2 \times A2$ is satisfied.

In the first check valve 103, the pressure in the fourth valve chest 121 becomes higher than the pressure in the third valve chest 133. Therefore, the second diaphragm 30B comes into contact with the second valve seat 132, so that the third valve chest 133 and the fourth valve chest 121 are blocked from each other.

Thus, when the pressure in the reservoir 109 increases, the first piezoelectric pump 101 and the second piezoelectric pump 102 become connected in series (see FIG. 10).

When the series connection is established, the outside air is sucked into the pump chamber 45 of the first piezoelectric pump 101 through the introduction hole 29 and the introduction chamber 111, is ejected into the seventh valve chest 112 from the pump chamber 45 of the first piezoelectric pump 101, and flows into the fourth valve chest 121 through the first valve chest 153, the opening 126, the communication path 124, and the communication hole 25. The air in the fourth valve chest 121 is sucked into the pump chamber 45 of the second piezoelectric pump 102, and is ejected into the discharge chamber 122 from the pump chamber 45 of the second piezoelectric pump 102. The air in the discharge chamber 122 is discharged into the reservoir 109 through the discharge hole 19, and the pressure (air pressure) in the reservoir 109 is increased to a desired pressure.

With the above-described structure, the two pumps, which are the first piezoelectric pump 101 and the second piezoelectric pump 102, are connected in parallel while the pressure in the reservoir 109 is low, and the state of connection between the first piezoelectric pump 101 and the second piezoelectric pump 102 switches to the series connection when the pressure in the reservoir 109 becomes high.

When the three pumps, which are the first piezoelectric pump 101 and the second piezoelectric pump 102, are connected in parallel, the maximum pump pressure of the gas control apparatus 100 is equal to that in the case where only one of the two pumps, which are the first piezoelectric pump 101 and the second piezoelectric pump 102, having a higher maximum pump pressure is connected to the reservoir 109, but the maximum flow rate is equal to the sum of the maximum pump flow rates of the individual pumps. In contrast, when the two pumps, which are the first piezoelectric pump 101 and the second piezoelectric pump 102, are connected in series, the maximum ejection flow rate of the gas control apparatus 100 is equal to that in the case where only one of the two pumps, which are the first piezoelectric pump 101 and the second piezoelectric pump 102, having a higher maximum pump flow rate is connected to the reservoir 109, but the maximum pump pressure is equal to the sum of the maximum pump pressures of the individual pumps.

In an initial stage of the operation in which no air is contained in the reservoir 109, the pump pressure may be low, but the flow rate is required to be high. With the gas control apparatus 100 of the present preferred embodiment, the parallel connection is established to introduce air into the reservoir 109 at a high flow rate until the reservoir 109 is no longer slack. In a later stage of the operation in which a sufficient amount of air has been introduced and the volume of the reservoir 109 becomes substantially constant, the flow rate may be low but the pump pressure is required to be high. With the gas control apparatus 100 of the present preferred embodiment, the series connection is established to allow highly compressed air to be introduced into the reservoir 109.

Thus, with the gas control apparatus 100 according to the present preferred embodiment, high-flow-rate characteristics are realized at a low pump pressure by the parallel connection, and high-pump-pressure characteristics are realized at a low flow rate by the series connection.

Figure 17A:
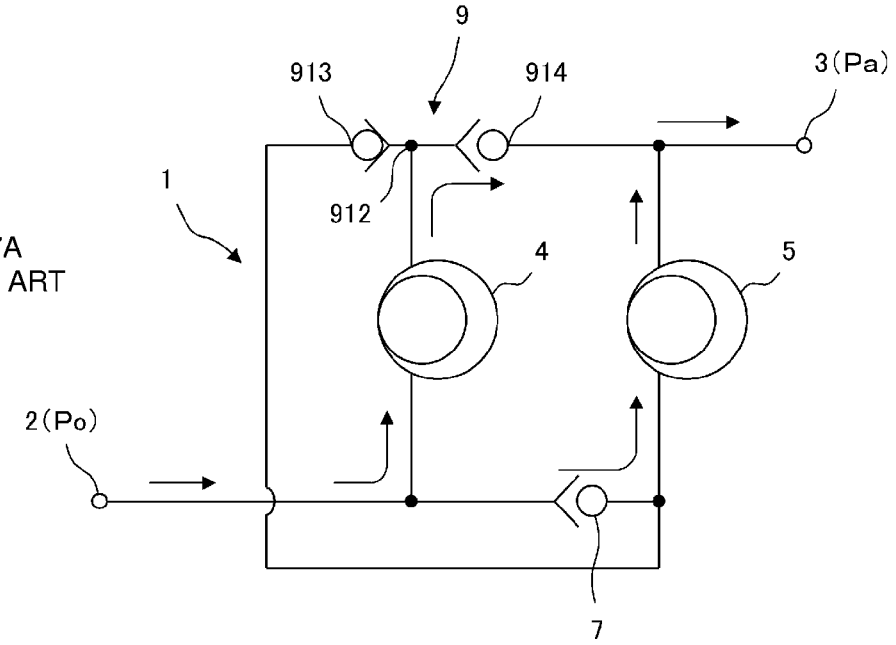
FIG. 17A PRIOR ART
FIG. 17A is a diagram illustrating the flow of air in a two-stage vacuum pump 1 according to Japanese Unexamined Utility Model Registration Application Publication No. 62-52291 in the state in which pumps 4 and 5 are connected in parallel.
Figure 17B:
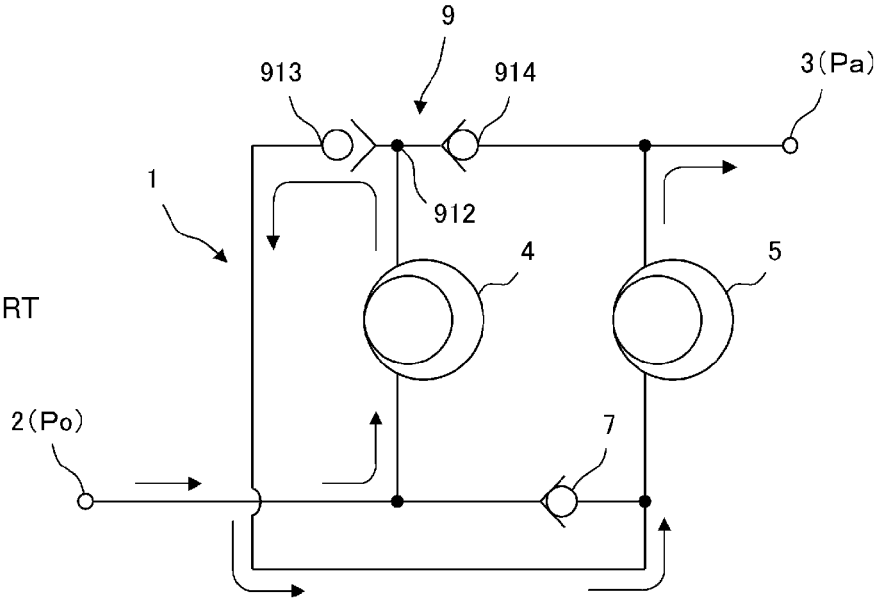
FIG. 17B PRIOR ART
FIG. 17B is a diagram illustrating the flow of air in the two-stage vacuum pump 1 according to Japanese Unexamined Utility Model Registration Application Publication No. 62-52291 in the state in which the pumps 4 and 5 are connected in series.
Figure 18:
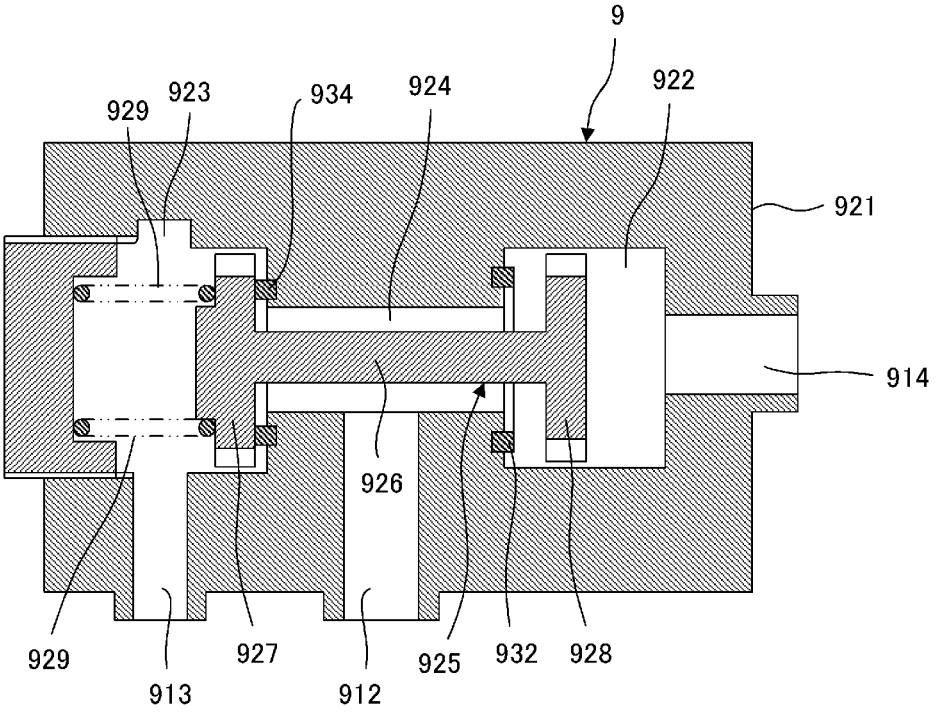
FIG. 18 PRIOR ART
FIG. 18 is a sectional view of a directional control valve 9 according to Japanese Unexamined Utility Model Registration Application Publication No. 62-52291.

With the directional control valve 9 illustrated in FIG. 17, the valve body 925 slides to alternatively switch the valve structure between the parallel-connection valve structure and the series-connection valve structure. In contrast, here, the parallel connection is gradually switched to the series connection in accordance with the displacements of the diaphragms that occur in response to the changes in the pressures in the valve chests. Therefore, the high-flow-rate characteristics smoothly switch to the high-pump-pressure characteristics.

In addition, in the gas control apparatus 100 according to the present preferred embodiment, no grease for improving the sealing performance between the diaphragm 30 and the upper housing 10 and between the diaphragm 30 and the lower housing 20 is required. Therefore, oil mist of the grease does not mix into air when the air passes through the upper housing 10 and the lower housing 20. Consequently, with the gas control apparatus 100 of the present preferred embodiment, clean air is discharged from the discharge hole 19.

Thus, with the gas control apparatus 100, a connection between a plurality of pumps is switched between the series connection and the parallel connection, and mixture of impurities into gas is prevented.

Furthermore, the gas control apparatus 100 has a simple structure in which the diaphragm 30 is sandwiched between the upper housing 10 and the lower housing 20. Therefore, the size, in particular, height, is significantly reduced and the performance (flow rate and pressure) of each pump is maintained.

Furthermore, in the present preferred embodiment, the first check valve 103, the second check valve 104, and the directional control valve 105 preferably include a single diaphragm 30, and the number of diaphragms may be one. Therefore, the gas control apparatus 100 of the present preferred embodiment is manufactured at low cost.

Second Preferred Embodiment

Figure 11:
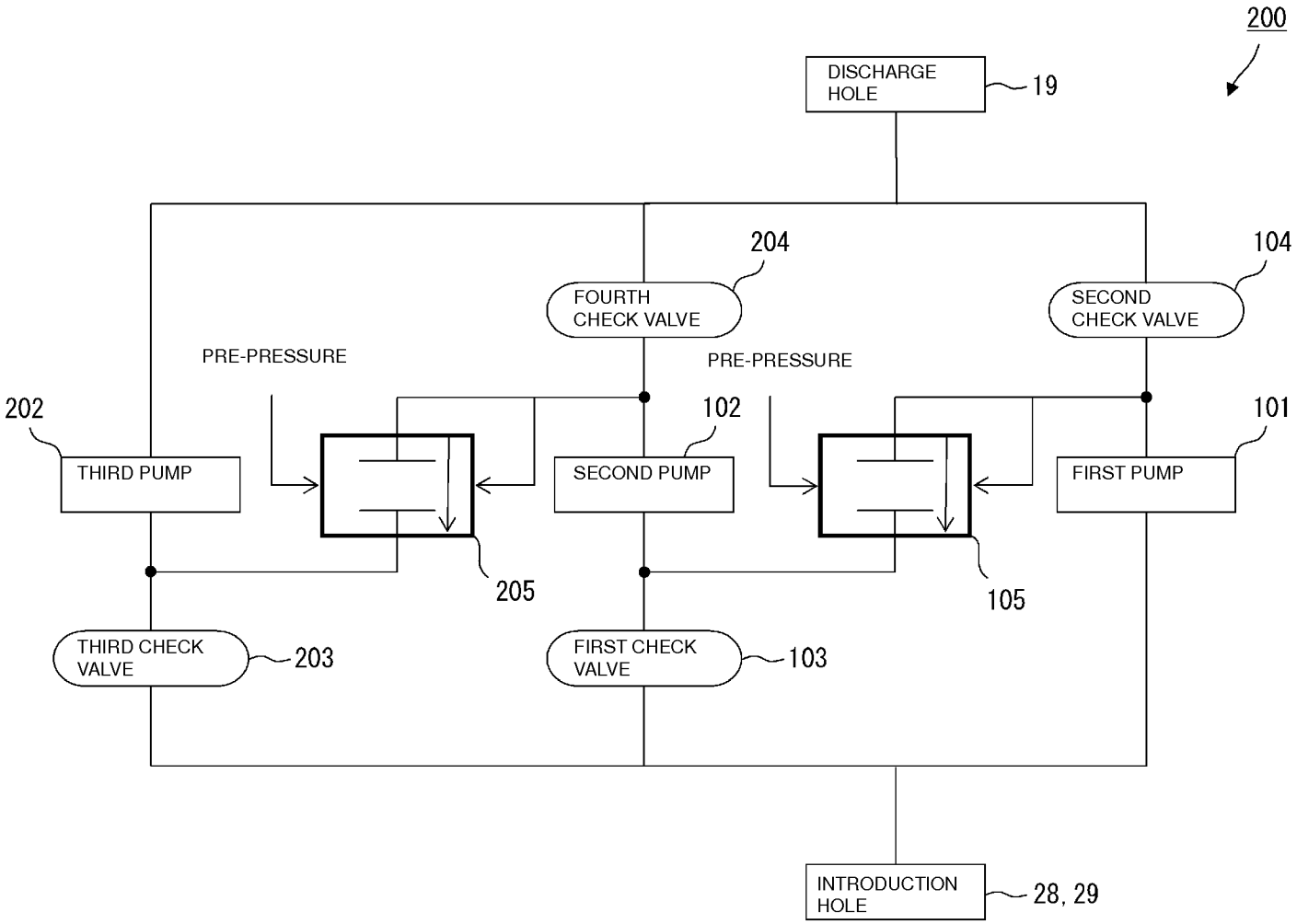
FIG. 11 is a block diagram illustrating the manner in which components included in a gas control apparatus 200 according to a second preferred embodiment of the present invention are connected.

FIG. 11 is a block diagram illustrating the manner in which a first piezoelectric pump 101, a second piezoelectric pump 102, a third piezoelectric pump 202, check valves 103, 104, 203, and 204, directional control valves 105 and 205, introduction holes 28 and 29, and a discharge hole 19, which are included in a gas control apparatus 200 according to a second preferred embodiment of the present invention, are connected.

The gas control apparatus 200 of the present preferred embodiment differs from the gas control apparatus 100 illustrated in FIG. 5 in that the piezoelectric pump 202, the check valves 203 and 204, and the directional control valve 205 are provided. Other structures are the same as those of the gas control apparatus 100 illustrated in FIG. 5. The third piezoelectric pump 202 preferably has the same structure as that of the first piezoelectric pump 101 illustrated in FIGS. 7 and 8. The check valves 203 and 204 preferably have the same structure as that of the check valve 103 illustrated in FIGS. 5 and 6. The directional control valve 205 preferably has the same structure as that of the directional control valve 105 illustrated in FIGS. 5 and 6.

In the above-described structure, the three pumps, which are the first piezoelectric pump 101, the second piezoelectric pump 102, and the third piezoelectric pump 202, are connected in parallel while the pressure in a reservoir 109 is low, and are connected in series when the pressure in the reservoir 109 becomes high.

When the two pumps, which are the first piezoelectric pump 101, the second piezoelectric pump 102, and the third piezoelectric pump 202, are connected in parallel, the maximum pump pressure of the gas control apparatus 200 is equal to that in the case where only one of the three pumps, which are the first piezoelectric pump 101, the second piezoelectric pump 102, and the third piezoelectric pump 202, having the highest maximum pump pressure is connected to the reservoir 109, but the maximum flow rate is equal to the sum of the maximum pump flow rates of the individual pumps. In contrast, when the three pumps, which are the first piezoelectric pump 101, the second piezoelectric pump 102, and the third piezoelectric pump 202, are connected in series, the maximum ejection flow rate of the gas control apparatus 200 is equal to that in the case where only one of the three pumps, which are the first piezoelectric pump 101, the second piezoelectric pump 102, and the third piezoelectric pump 202, having the highest maximum pump flow rate is connected to the reservoir 109, but the maximum pump pressure is equal to the sum of the maximum pump pressures of the individual pumps.

Thus, also with the gas control apparatus 200 according to the present preferred embodiment, characteristics in which a high flow rate is achieved at a low pump pressure are realized by the parallel connection, and characteristics in which a high pump pressure are achieved at a low flow rate is realized by the series connection. In addition, since the parallel connection is gradually switched to the series connection in accordance with the displacements of the diaphragms that occur in response to the changes in the pressures in the valve chests, the high-flow-rate characteristics smoothly switch to the high-pump-pressure characteristics.

Furthermore, also in the gas control apparatus 200 of the present preferred embodiment, since the diaphragm 30 is flexible and comes into tight contact with the housing 110, gas leakage does not occur. In addition, since no sliding occurs when the diaphragm 30 comes into contact with or separates from the housing 110, it is not necessary to apply grease between the diaphragm 30 and the housing 110. Therefore, mixture of impurities into gas is prevented.

Thus, the gas control apparatus 200 according to the present preferred embodiment provides effects similar to those of the gas control apparatus 100.

Figure 12:
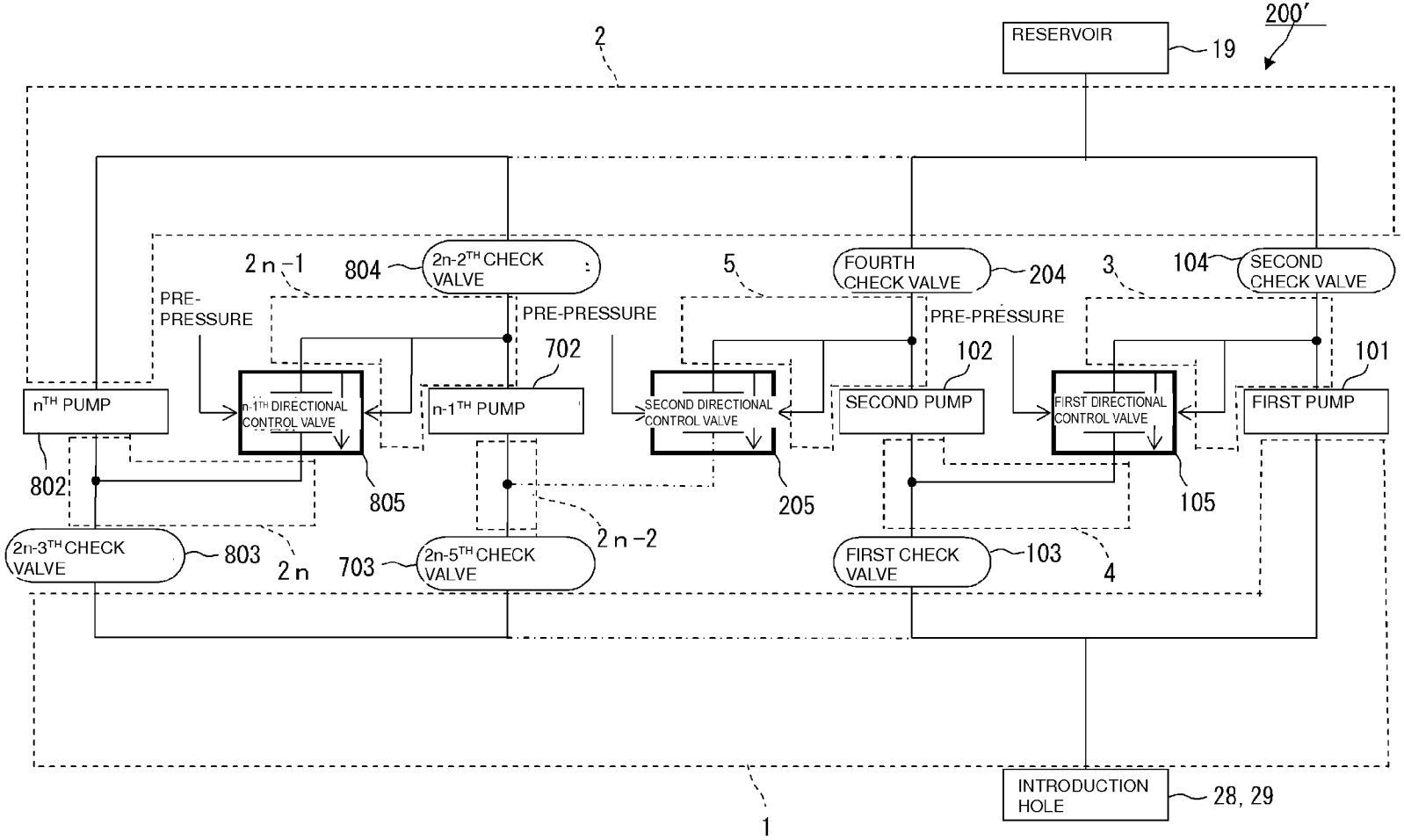
FIG. 12 is a block diagram illustrating the manner in which components included in a gas control apparatus 200' according to a modification of the second preferred embodiment of the present invention are connected.

It is clear from the above that, also when n piezoelectric pumps are connected as illustrated in FIG. 12, effects similar to those of the gas control apparatus 100 are achieved.

FIG. 12 is a block diagram illustrating the manner in which a first piezoelectric pump 101, a second piezoelectric pump 102, an $n-1^{th}$ piezoelectric pump 702, an $n^{th}$ piezoelectric pump 802, check valves 103, 104, 204, 703, 803, and 804, directional control valves 105, 205, and 805, introduction holes 28 and 29, and a discharge hole 19, which are included in a gas control apparatus 200' according to a modification of the second preferred embodiment of the present invention, are connected.

In FIG. 12, the first piezoelectric pump 101 of the first stage is referred to as a first pump, the second piezoelectric pump 102 of the second stage is referred to as a second pump, the $n-1^{th}$ piezoelectric pump 702 of the $n-1^{th}$ stage is referred to as a $n-1^{th}$ pump, and the $n^{th}$ piezoelectric pump 802 of the $n^{th}$ stage is referred to as an $n^{th}$ pump. Similarly, the directional control valve 105 of the first stage is referred to as a first directional control valve, the directional control valve 205 of the second stage is referred to as a second directional control valve, and the directional control valve 805 of the $n-1^{th}$ stage is referred to as an $n-1^{th}$ directional control valve. Similarly, the check valve 103 of the first stage is referred to as a first check valve, the check valve 703 of the $n-1^{th}$ stage is referred to as a $2n-5^{th}$ check valve, and the check valve 803 of the $n^{th}$ stage is referred to as a $2n3^{th}$ check valve. In addition, the check valve 104 of the first stage is referred to as a second check valve, the check valve 204 of the second stage is referred to as a fourth check valve, and the check valve 804 of the $n^{th}$ stage is referred to as a $2n-2^{th}$ check valve.

In this structure, the gas control apparatus 200' includes a housing having the introduction holes 28 and 29 and the discharge hole 19, a diaphragm, the first pump, the $t^{th}$ pump, and the $n^{th}$ pump. Here, t represents integers of 2 to n−1, and n is an integer of 4 or more.

The diaphragm of the gas control apparatus 200' divides the inside of the housing into a first region 1 that communicates with the introduction holes 28 and 29, a second region 2 that communicates with the discharge hole 19, a third region 3, a $2t^{th}$ region, a $2t+1^{th}$ region, and a $2n^{th}$ region 2n.

The region surrounded by the first pump, the first directional control valve, and the second check valve corresponds to the third region 3. The region surrounded by the second pump, the first directional control valve, and the first check valve corresponds to the fourth region 4. The region surrounded by the second pump, the second directional control valve, and the fourth check valve corresponds to the fifth region 5. Similarly, the region surrounded by the $n-1^{th}$ pump, the $n-2^{th}$ directional control valve, and the $2n-5^{th}$ check valve corresponds to the $2n-2^{th}$ region 2n−2, and the region surrounded by the $n-1^{th}$ pump, the $n-1^{th}$ directional control valve, and the $2n-2^{th}$ check valve corresponds to the $2n-1^{th}$ region 2n−1. The region surrounded by the $n^{th}$ pump, the $n-1^{th}$ directional control valve, and the $2n-3^{th}$ check valve corresponds to the $2n^{th}$ region 2n.

The first pump includes a first pump chamber, a first suction hole, and a first ejection hole, the first suction hole and the first ejection hole communicating with each other through the first pump chamber. The first suction hole communicates with the first region 1, and the first ejection hole communicates with the third region 3. The $t^{th}$ pump includes a $t^{th}$ pump chamber, a $t^{th}$ suction hole, and a $t^{th}$ ejection hole, the $t^{th}$ suction hole and the $t^{th}$ ejection hole communicating with each other through the $t^{th}$ pump chamber. The $t^{th}$ suction hole communicates with the $2t^{th}$ region, and the $t^{th}$ ejection hole communicates with the $2t+1^{th}$ region. The $n^{th}$ pump includes an $n^{th}$ pump chamber, an $n^{th}$ suction hole, and an $n^{th}$ ejection hole, the $n^{th}$ suction hole and the $n^{th}$ ejection hole communicating with each other through the $n^{th}$ pump chamber. The $n^{th}$ suction hole communicates with the $2n^{th}$ region 2n, and the $n^{th}$ ejection hole communicates with the second region 2.

The diaphragm of the gas control apparatus 200' is fixed to the housing so that, while the first, $t^{th}$, and $n^{th}$ pumps are in operation, when the pressures in the third region 3 and the $2t+1^{th}$ region are higher than the pressure in the second region 2 and the pressures in the $2t^{th}$ region and the $2n^{th}$ region 2n are lower than the pressure in the first region 1, the third region 3 and the $2t+1^{th}$ region are blocked from the $2t^{th}$ region and the $2n^{th}$ region 2n, respectively, each of the third region 3 and the $2t+1^{th}$ region communicates with the second region 2, and each of the $2t^{th}$ region and the $2n^{th}$ region 2n communicates with the first region, and when the pressures in the third region 3 and the $2t+1^{th}$ region are lower than the pressure in the second region 2 and the pressures in the $2t^{th}$ region and the $2n^{th}$ region 2n are higher than the pressure in the first region 1, each of the third region 3 and the $2t+1^{th}$ region is blocked from the second region 2, each of the $2t^{th}$ region and the $2n^{th}$ region 2n is blocked from the first region 1, and the third region 3 and the $2t+1^{th}$ region communicate with the $2t^{th}$ region and the $2n^{th}$ region 2n, respectively.

In the above-described structure, the n piezoelectric pumps 101, 102, . . . , 702, and 802 are connected in parallel while the pressure in a reservoir 109 is low, and are connected in series when the pressure in the reservoir 109 becomes high.

When the n piezoelectric pumps 101, 102, . . . , 702, and 802 are connected in parallel, the maximum pump pressure of the gas control apparatus 200' is equal to that in the case where only one of the n piezoelectric pumps 101, 102, . . . , 702, and 802 having the highest maximum pump pressure is connected to the reservoir 109, but the maximum flow rate is equal to the sum of the maximum pump flow rates of the individual pumps. In contrast, when the n piezoelectric pumps 101, 102, . . . , 702, and 802 are connected in series, the maximum ejection flow rate of the gas control apparatus 200' is equal to that in the case where only one of the n piezoelectric pumps 101, 102, . . . , 702, and 802 having the highest maximum pump flow rate is connected to the reservoir 109, but the maximum pump pressure is equal to the sum of the maximum pump pressures of the individual pumps.

Thus, also with the gas control apparatus 200' according to the present preferred embodiment, characteristics in which a high flow rate is achieved at a low pump pressure are realized by the parallel connection, and characteristics in which a high pump pressure is achieved at a low flow rate are realized by the series connection. In addition, since the parallel connection is gradually switched to the series connection in accordance with the displacements of the diaphragms that occur in response to the changes in the pressures in the valve chests, the high-flow-rate characteristics smoothly switch to the high-pump-pressure characteristics.

In addition, also in the gas control apparatus 200' according to the present preferred embodiment, it is not necessary to provide a gap between the diaphragm and the housing, and the gas control apparatus 200' has a simple structure in which the diaphragm is fixed to the housing.

Thus, according to the present preferred embodiment, also when n piezoelectric pumps are connected as illustrated in FIG. 12, effects similar to those of the gas control apparatus 100 are achieved.

Third Preferred Embodiment

Figure 13:
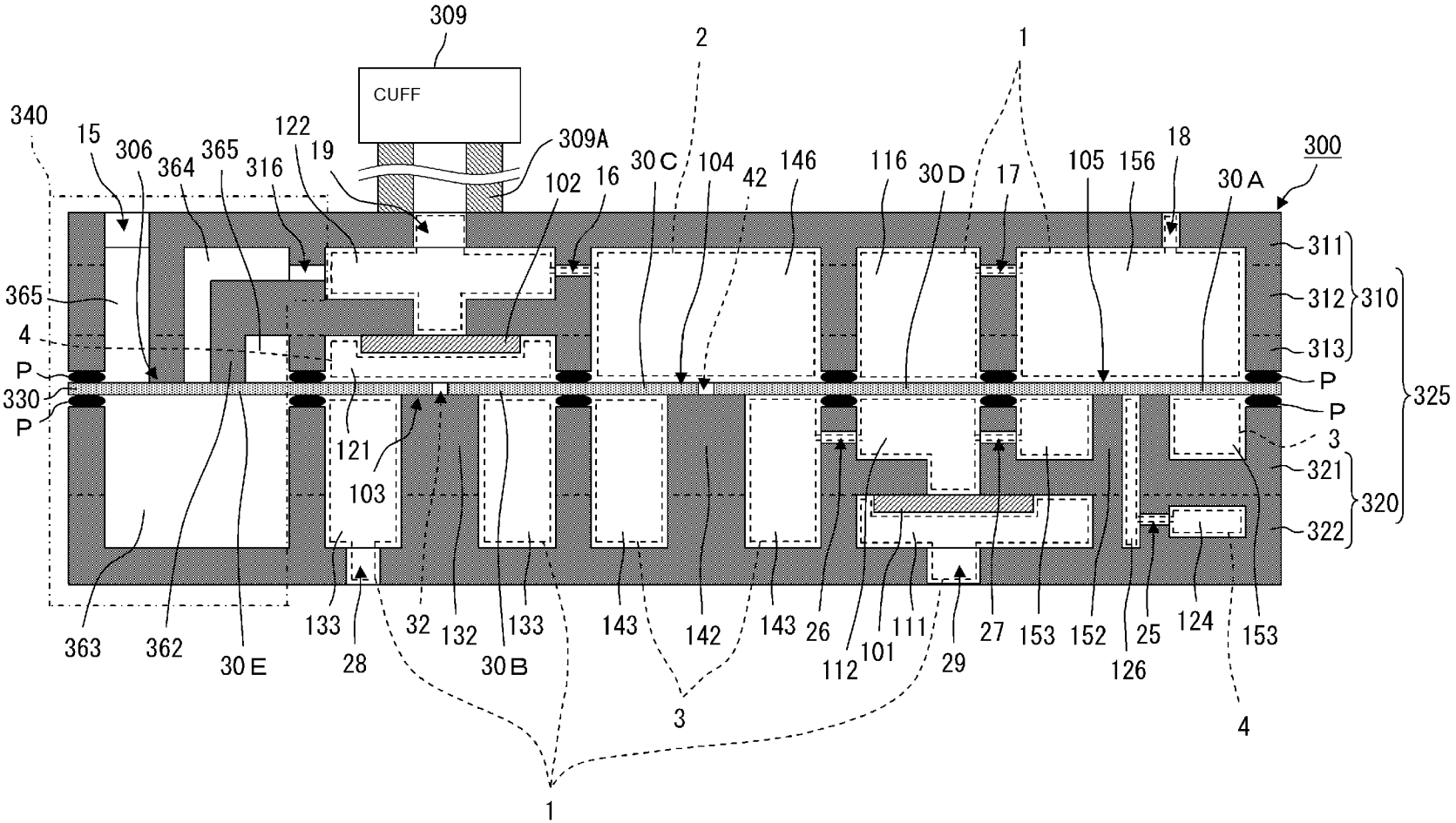
FIG. 13 is a sectional view of a gas control apparatus 300 according to a third preferred embodiment of the present invention.

FIG. 13 is a sectional view of a gas control apparatus 300 according to a third preferred embodiment of the present invention. The gas control apparatus 300 of this preferred embodiment differs from the gas control apparatus 100 in that the gas control apparatus 300 includes a quick exhaust portion 340 configured to perform a quick exhaust operation. Other structures are the same as those of the gas control apparatus 100. Therefore, the gas control apparatus 300 is suitable for connection with a cuff 309 which is used in blood pressure measurements and which needs to be quickly exhausted after being filled with compressed air. The cuff 309 also corresponds to a "reservoir". The quick exhaust portion 340 includes an exhaust valve 306, and is connected to a discharge chamber 122 through a communication hole 316.

As illustrated in FIG. 13, the gas control apparatus 300 includes a housing 325 and a diaphragm 330. The housing 325 includes an upper housing 310 and a lower housing 320. A rubber tube 309A of the cuff 309 is connected to a discharge hole 19 formed in the upper housing 310 of the gas control apparatus 300.

In FIG. 13, to improve visibility of the structure of the gas control apparatus 300, the upper housing 310 is divided into three layers, which are a lid portion 311, an intermediate portion 312, and a first clamping portion 313, and the lower housing 320 is divided into two layers, which are a second clamping portion 321 and a bottom plate 322. Boundaries between the layers are shown by dotted lines.

The upper housing 310 of the gas control apparatus 300 has an outlet 15 through which the air in the cuff 309 is exhausted to the outside, the communication hole 316 that communicates with the discharge chamber 122, an opening 364 that communicates with the communication hole 316, and a fourth valve seat 362 having a cylindrical shape that projects toward a fifth diaphragm 30E from a region around the opening 364.

The diaphragm 330 additionally includes the fifth diaphragm 30E. In other words, a first diaphragm 30A, a second diaphragm 30B, a third diaphragm 30C, a fourth diaphragm 30D, and the fifth diaphragm 30E are preferably defined by a single common diaphragm 330.

The fifth diaphragm 30E divides the inner space of the upper housing 310 and the lower housing 320 into a ring-shaped exhaust chamber 365 that communicates with the outlet 15 and a ninth valve chest 363 having a columnar shape that communicates with a seventh valve chest 112 through a communication hole (not shown). The fifth diaphragm 30E is in contact with the fourth valve seat 362, and defines the exhaust valve 306 together with the upper housing 310 and the lower housing 320.

A first check valve 103, a second check valve 104, a directional control valve 105, and the exhaust valve 306 are preferably integral with each other. With this structure, the gas control apparatus 300 includes a first piezoelectric pump 101, a second piezoelectric pump 102, the first check valve 103, the second check valve 104, the directional control valve 105, and the exhaust valve 306.

The exhaust valve 306 includes the fifth diaphragm 30E, the exhaust chamber 365, the ninth valve chest 363, and the fourth valve seat 362. The fourth valve seat 362 is provided on the upper housing 310 so as to pre-press the fifth diaphragm 30E.

With the above-described structure, the exhaust valve 306 switches the state of connection between the exhaust chamber 365 and the opening 364 between connected and disconnected states in accordance with the difference between forces applied to both principal surfaces of the fifth diaphragm 30E.

The operation of the gas control apparatus 300 in a blood pressure measurement process will now be described.

A general blood pressure meter gradually increases a pump pressure by filling a cuff with air, successively measures systolic and diastolic blood pressures while slowly exhausting the air, and then quickly exhausts the air remaining in the cuff.

Figure 14:
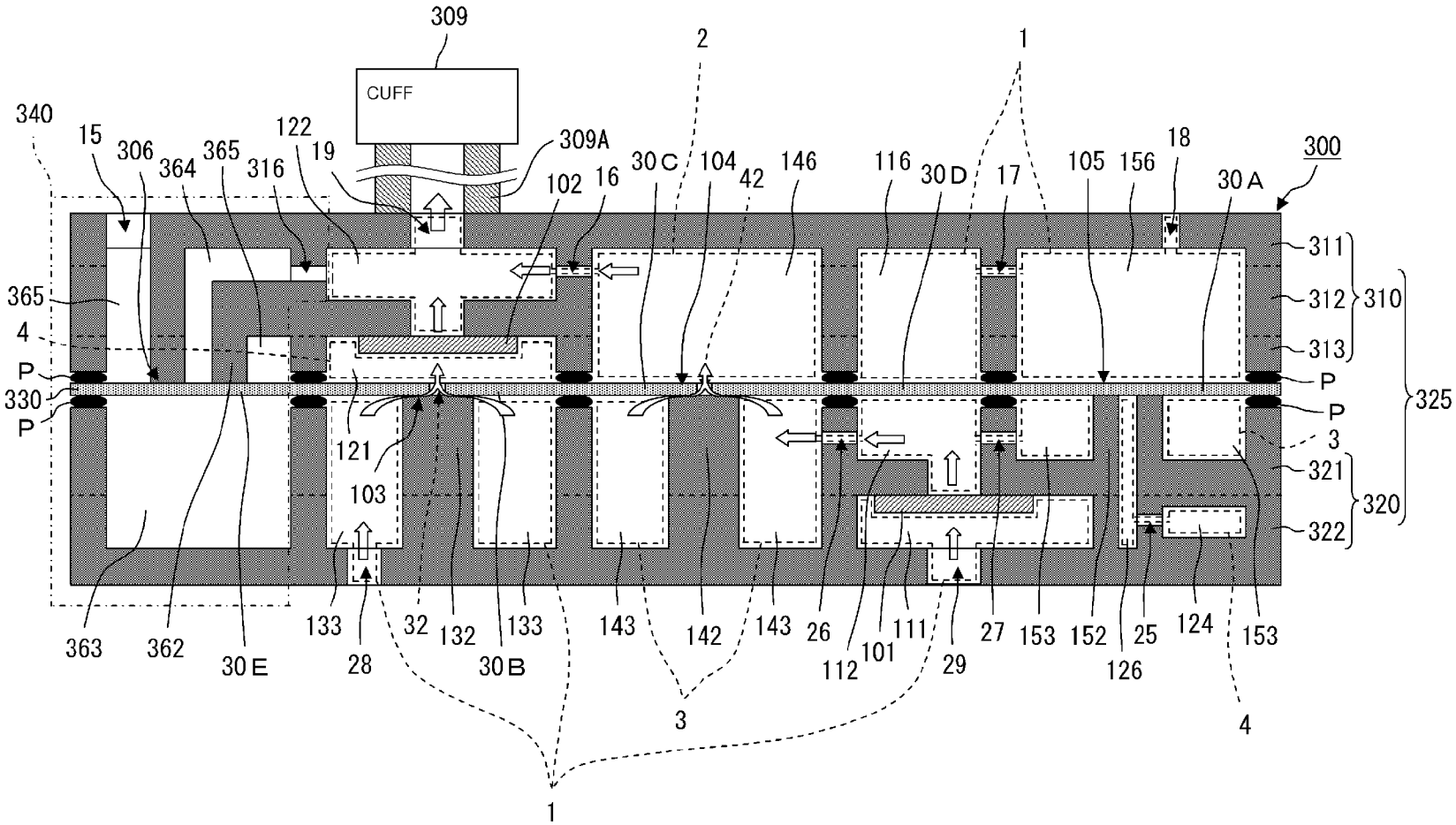
FIG. 14 is a sectional view illustrating the flow of air in the gas control apparatus 300 in the state in which a first piezoelectric pump 101 and a second piezoelectric pump 102 are connected in parallel according to the third preferred embodiment of the present invention.
Figure 15:
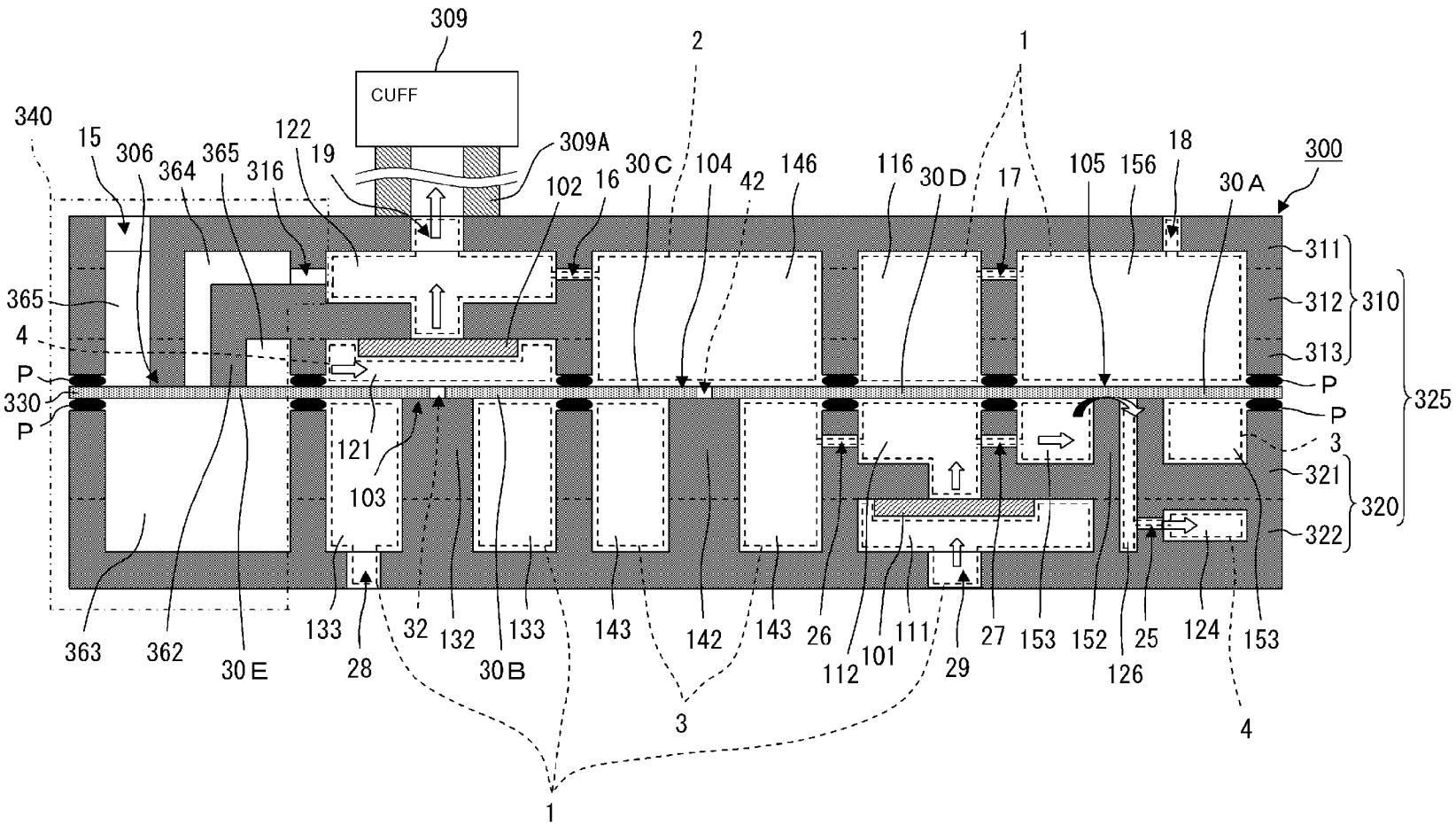
FIG. 15 is a sectional view illustrating the flow of air in the gas control apparatus 300 in the state in which the first piezoelectric pump 101 and the second piezoelectric pump 102 are connected in series according to the third preferred embodiment of the present invention.
Figure 16:
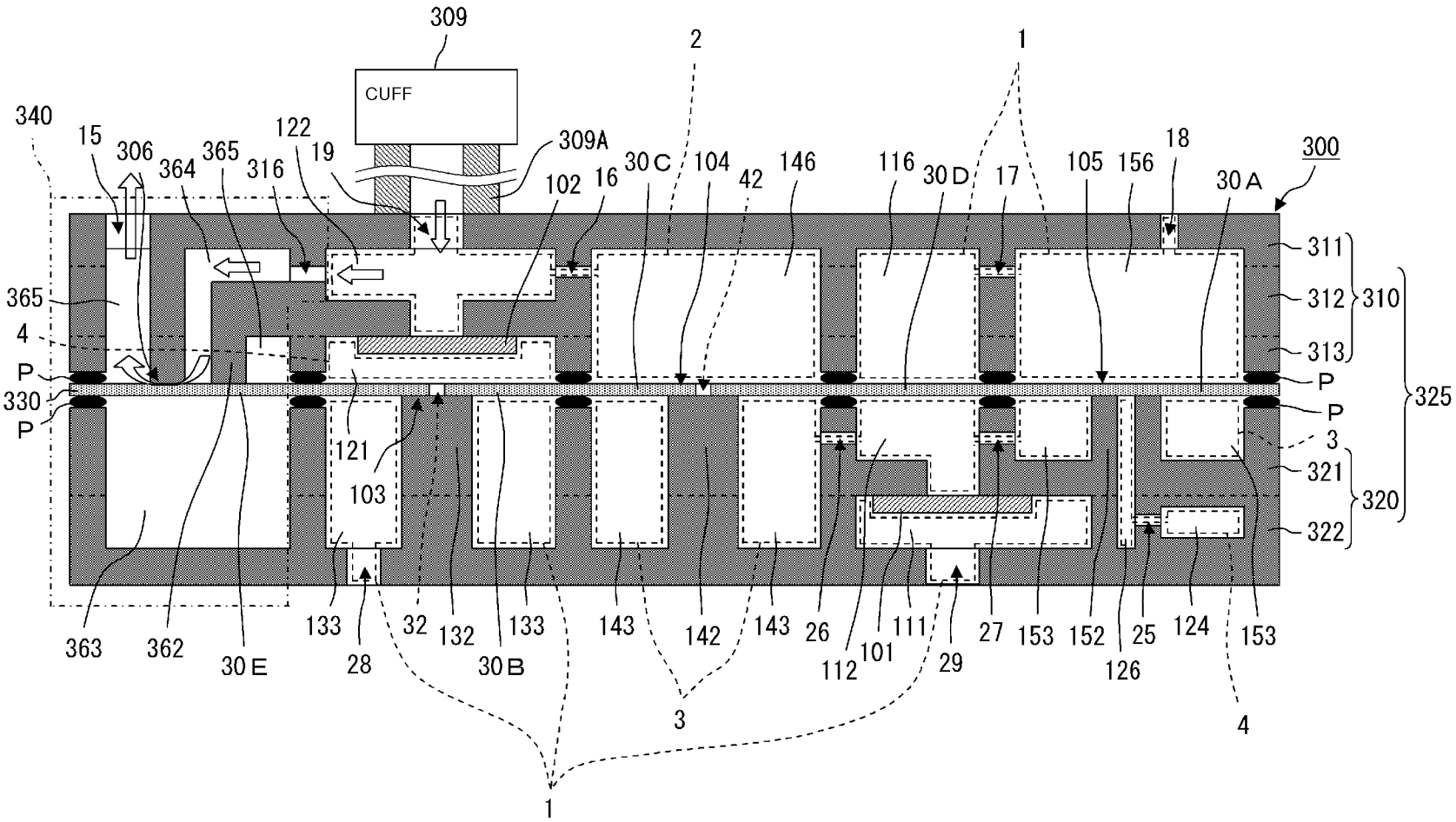
FIG. 16 is a sectional view illustrating the flow of air in the gas control apparatus 300 immediately after the first piezoelectric pump 101 and the second piezoelectric pump 102 stop operating according to the third preferred embodiment of the present invention.

FIG. 14 is a sectional view illustrating the flow of air in the gas control apparatus 300 in the state in which the first piezoelectric pump 101 and the second piezoelectric pump 102 illustrated in FIG. 13 are connected in parallel. FIG. 15 is a sectional view illustrating the flow of air in the gas control apparatus 300 in the state in which the first piezoelectric pump 101 and the second piezoelectric pump 102 illustrated in FIG. 13 are connected in series. FIG. 16 is a sectional view illustrating the flow of air in the gas control apparatus 300 immediately after the first piezoelectric pump 101 and the second piezoelectric pump 102 illustrated in FIG. 13 stop operating.

Referring to FIG. 14, the flow of air in the gas control apparatus 300 when the first piezoelectric pump 101 and the second piezoelectric pump 102 are connected in parallel are the same as the flow of air in the gas control apparatus 100 when the first piezoelectric pump 101 and the second piezoelectric pump 102 are connected in parallel (see FIG. 9).

Referring to FIG. 15, the flow of air in the gas control apparatus 300 when the first piezoelectric pump 101 and the second piezoelectric pump 102 are connected in series are the same as the flow of air in the gas control apparatus 100 when the first piezoelectric pump 101 and the second piezoelectric pump 102 are connected in series (see FIG. 10).

Since the ninth valve chest 363 communicates with the seventh valve chest 112 as described above, the exhaust valve 306 remains closed while the first piezoelectric pump 101 and the second piezoelectric pump 102 are in operation.

After the blood pressure measurement, the gas control apparatus 300 stops the operation of the first piezoelectric pump 101 and the second piezoelectric pump 102. Here, the volumes of a pump chamber 45 of the first piezoelectric pump 101, the seventh valve chest 112, and the ninth valve chest 363 are far smaller than the volume of the air that is received by the cuff 309.

Therefore, when the operation of the first piezoelectric pump 101 and the second piezoelectric pump 201 is stopped, the air in the pump chamber 45 of the first piezoelectric pump 101, the seventh valve chest 112, and the ninth valve chest 363 is quickly discharged to the outside of the gas control apparatus 300 from an introduction hole 29 of the gas control apparatus 300 through a suction hole 52 and an opening 92 in the first piezoelectric pump 101. In addition, the opening 364 in the exhaust valve 306 of the quick exhaust portion 340 receives the pressure of the cuff 309.

As a result, in the exhaust valve 306 of the quick exhaust portion 340, when the operation of the first piezoelectric pump 101 and the second piezoelectric pump 102 is stopped, the pressure in the ninth valve chest 363 immediately decreases and the fifth diaphragm 30E is opened so that the opening 364 and the exhaust chamber 365 communicate with each other. Therefore, the air in the cuff 309 is quickly exhausted from the outlet 15 through the discharge chamber 122, the communication hole 316, the opening 364, and the exhaust chamber 365 (see FIG. 16).

Thus, with the gas control apparatus 300 according to the present preferred embodiment, the air is quickly exhausted from the cuff 309 after the cuff 309 is filled with compressed air.

Other Preferred Embodiments

Although air is preferably used as gas in the above-described preferred embodiments, the gas is not limited to this, and gases other than air may instead be used.

Furthermore, although piezoelectric pumps preferably are provided in the above-described preferred embodiments, the pumps are not limited to this. For example, electromagnetic pumps that are driven electromagnetically may be provided instead of the piezoelectric pumps.

Furthermore, although the piezoelectric element 44 preferably is formed of a lead zirconate titanate ceramic in the above-described preferred embodiments, the piezoelectric element is not limited to this, and may instead be formed of, for example, a piezoelectric material including a lead-free piezoelectric ceramic such as a potassium sodium niobate ceramic or an alkali niobate ceramic.

Furthermore, although the piezoelectric actuator 40 performs unimorph-type bending vibration in the above-described preferred embodiments, the piezoelectric actuator 40 may instead be structured such that piezoelectric elements 44 are bonded to both surfaces of the vibrating plate 41 and bimorph-type bending vibration is performed.

Furthermore, in each of the above-described preferred embodiments, the flexible plate 51 is preferably configured to perform bending vibration in response to the bending vibration of the piezoelectric actuator 40. However, the configuration is not limited to this, and may instead be such that only the piezoelectric actuator 40 performs bending vibration. It is not necessary that the flexible plate 51 performs bending vibration in response to the bending vibration of the piezoelectric actuator 40.

Furthermore, although the piezoelectric actuator 40 preferably is disc-shaped in each of the above-described preferred embodiments, the piezoelectric actuator 40 is not limited to this, and may instead have, for example, a rectangular plate shape, a polygonal plate shape, or an oval plate shape.

Furthermore, in the above-described preferred embodiments, the second valve chest 156 preferably is open to the atmosphere through the vent 18. However, the second valve chest 156 is not limited to this. For example, a pressure may be applied to the first diaphragm 30A by filling the second valve chest 156 with an elastic member instead of opening the second valve chest 156 to the atmosphere. In this case, when the force of the elastic member is F, the elastic member is configured so that F satisfies the relationship P1×A1>P2×A2+F.

Furthermore, in the above-described preferred embodiments, the first check valve 103 or the second check valve 104 preferably includes a valve seat and a diaphragm having a hole in a portion of a region in which the diaphragm contacts an end portion of the valve seat. However, the first and second check valves 103 and 104 are not limited to this. For example, the first check valve 103 or the second check valve 104 may have a structure similar to the structure of the directional control valve 152.

Lastly, it should be understood that the above-described preferred embodiments are illustrative and not limitative in all aspects. The scope of the present invention is defined not by the above-described preferred embodiments but by the scope of the claims. Furthermore, the scope of the present invention is intended to include meanings equivalent to the scope of the claims and all modifications within the scope.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A gas control apparatus comprising:

a housing including an introduction hole and a discharge hole;

a first check valve and a second check valve that are disposed between the introduction hole and the discharge hole and configured to block flow of gas from the discharge hole to the introduction hole;

a first pump including a suction hole connected to the introduction hole and an ejection hole connected to the second check valve;

a second pump including a suction hole connected to the first check valve and an ejection hole connected to the discharge hole; and a directional control valve disposed between the ejection hole of the first pump and the suction hole of the second pump; wherein the first check valve, the second check valve, the first pump, the second pump, and the directional control valve are disposed in the housing;

the directional control valve includes a first diaphragm, first and second valve chests partitioned from each other by the first diaphragm, and a first valve seat disposed in the first valve chest;

the first diaphragm includes first and second opposed principal surfaces and a region in which the first diaphragm contacts the first valve seat;

the first valve seat includes an opening connected to the suction hole of the second pump;

the first valve chest is connected to the ejection hole of the first pump; and the directional control valve is configured to switch a state of connection between the first pump ejection hole and the suction hole of the second pump between connected and disconnected states in accordance with a difference between forces applied to both of the first and second principal surfaces of the first diaphragm.

2. The gas control apparatus according to claim 1, wherein the first check valve includes a second diaphragm, third and fourth valve chests partitioned from each other by the second diaphragm, and a second valve seat disposed in the third valve chest;

the second diaphragm includes a region in which the second diaphragm contacts an end portion of the second valve seat and a hole that extends through a portion of the region; and the third valve chest is connected to the introduction hole, and the fourth valve chest is connected to the suction hole of the second pump.

3. The gas control apparatus according to claim 2, wherein the second check valve includes a third diaphragm, fifth and sixth valve chests partitioned from each other by the third diaphragm, and a third valve seat disposed in the fifth valve chest;

the third diaphragm includes a region in which the third diaphragm contacts an end portion of the third valve seat and a hole that extends through a portion of the region; and the fifth valve chest is connected to the ejection hole of the first pump, and the sixth valve chest is connected to the discharge hole.

4. The gas control apparatus according to claim 1, wherein the housing further includes a vent;

the second valve chest of the directional control valve is connected to the vent; and a pressure in the second valve chest is an atmospheric pressure.

5. The gas control apparatus according to claim 3, wherein the first, second, and third diaphragms are defined by a single common diaphragm.

6. The gas control apparatus according to claim 5, wherein the first, second, and third valve seats are configured and arranged on the housing so as to pre-press the diaphragm.

7. The gas control apparatus according to claim 5, wherein the housing includes a first housing including the introduction hole and a second housing including the discharge hole; and the diaphragm is defined by an elastic member, and is sandwiched by the first housing and the second housing from both sides.

8. The gas control apparatus according to claim 1, wherein the discharge hole is connected to a reservoir; and the gas control apparatus further comprises an exhaust portion that communicates with the discharge hole and that is configured to discharge gas when the first and second pumps stop to operate, the gas having been introduced into the reservoir by an operation of the first and second pumps.

9. A gas control apparatus comprising:

a housing including an introduction hole and a discharge hole;

a diaphragm configured to divide an inner space of the housing to define a first region that communicates with the introduction hole, a second region that communicates with the discharge hole, a third region, and a fourth region in the housing;

a first pump including a first pump chamber, a first suction hole, and a first ejection hole, the first suction hole and the first ejection hole communicating with each other through the first pump chamber, the first suction hole communicating with the first region, and the first ejection hole communicating with the third region; and a second pump including a second pump chamber, a second suction hole, and a second ejection hole, the second suction hole and the second ejection hole communicating with each other through the second pump chamber, the second suction hole communicating with the fourth region, and the second ejection hole communicating with the second region; and the diaphragm is configured and fixed to the housing such that:

when a pressure in the third region is higher than a pressure in the second region and a pressure in the fourth region is lower than a pressure in the first region while the first and second pumps are in operation, the third region and the fourth region are blocked from each other, the second region and the third region communicate with each other, and the first region and the fourth region communicate with each other; and when the pressure in the third region is lower than the pressure in the second region and the pressure in the fourth region is higher than the pressure in the first region while the first and second pumps are in operation, the second region and the third region are blocked from each other, the first region and the fourth region are blocked from each other, and the third region and the fourth region communicate with each other.

10. The gas control apparatus according to claim 9, wherein the housing includes an opening that communicates with the fourth region, a first valve seat that projects from a region around the opening toward the diaphragm in the third region, a second valve seat that projects toward the diaphragm in the first region, and a third valve seat that projects toward the diaphragm in the third region;

the diaphragm is configured and fixed to the housing so that the diaphragm contacts the first valve seat, the second valve seat, and the third valve seat; and the diaphragm includes a hole in a portion of the diaphragm that contacts the second valve seat and a hole in a portion of the diaphragm that contacts the third valve seat.

11. The gas control apparatus according to claim 10, wherein the diaphragm is configured to come into contact with or separate from the first valve seat in accordance with a pressure difference between the first region and the third region to switch between open and closed states, come into contact with or separate from the second valve seat in accordance with a pressure difference between the first region and the fourth region to switch between open and closed states, and come into contact with or separate from the third valve seat in accordance with a pressure difference between the second region and the third region to switch between open and closed states.

12. The gas control apparatus according to claim 10, wherein the diaphragm is configured to define, together with the housing, a first check valve configured to open and close in accordance with the pressure difference between the first region and the fourth region, a second check valve configured to open and close in accordance with the pressure difference between the second region and the third region, and a directional control valve configured to open and close in accordance with the pressure difference between the first region and the third region;

the first check valve is configured to prevent gas from flowing from the fourth region to the first region;

the second check valve is configured to prevent gas from flowing from the second region to the third region; and while the first and second pumps are in operation, the directional control valve is configured to block the third region and the fourth region from each other when the pressure in the third region is higher than the pressure in the second region and the pressure in the fourth region is lower than the pressure in the first region, and connect the third region and the fourth region to each other when the pressure in the third region is lower than the pressure in the second region and the pressure in the fourth region is higher than the pressure in the first region.

13. The gas control apparatus according to claim 10, wherein the first, second, and third valve seats are configured and arranged on the housing so as to pre-press the diaphragm.

14. The gas control apparatus according to claim 9, wherein the housing includes a first housing including the introduction hole and a second housing including the discharge hole; and the diaphragm is defined by an elastic member, and is sandwiched by the first housing and the second housing from both sides.

15. The gas control apparatus according to claim 9, wherein the discharge hole is connected to a reservoir; and the gas control apparatus further comprises an exhaust portion that communicates with the discharge hole and that is configured to discharge gas when the first and second pumps stop to operate, the gas having been introduced into the reservoir by an operation of the first and second pumps.

16. A gas control apparatus comprising:

a housing including an introduction hole and a discharge hole;

a diaphragm configured to divide an inner space of the housing to define a first region that communicates with the introduction hole, a second region that communicates with the discharge hole, a third region, a $2t^{th}$ region, a $2t+1^{th}$ region, and a $2n^{th}$ region in the housing, where n is an integer of 3 or more and t is an integer from 2 to n−1;

a first pump including a first pump chamber, a first suction hole, and a first ejection hole, the first suction hole and the first ejection hole communicating with each other through the first pump chamber, the first suction hole communicating with the first region, and the first ejection hole communicating with the third region;

a $t^{th}$ pump including a $t^{th}$ pump chamber, a $t^{th}$ suction hole, and a $t^{th}$ ejection hole, the $t^{th}$ suction hole and the $t^{th}$ ejection hole communicating with each other through the $t^{th}$ pump chamber, the $t^{th}$ suction hole communicating with the $2t^{th}$ region, and the $t^{th}$ ejection hole communicating with the $2t+1^{th}$ region; and an $n^{th}$ pump including an $n^{th}$ pump chamber, an $n^{th}$ suction hole, and an $n^{th}$ ejection hole, the $n^{th}$ suction hole and the $n^{th}$ ejection hole communicating with each other through the $n^{th}$ pump chamber, the $n^{th}$ suction hole communicating with the $2n^{th}$ region, and the $n^{th}$ ejection hole communicating with the second region; wherein the n pumps are connected to each other;

the diaphragm is configured and fixed to the housing such that:

when pressures in the third region and the $2t+1^{th}$ region are higher than a pressure in the second region and pressures in the $2t^{th}$ region and the $2n^{th}$ region are lower than a pressure in the first region while the first, $t^{th}$, and $n^{th}$ pumps are in operation, the third region and the $2t+1^{th}$ region are blocked from the $2t^{th}$ region and the $2n^{th}$ region, respectively, each of the third region and the $2t+1^{th}$ region communicates with the second region, and each of the $2t^{th}$ region and the $2n^{th}$ region communicates with the first region; and when the pressures in the third region and the $2t+1^{th}$ region are lower than the pressure in the second region and the pressures in the $2t^{th}$ region and the $2n^{th}$ region are higher than the pressure in the first region while the first, $t^{th}$, and $n^{th}$ pumps are in operation, each of the third region and the $2t+1^{th}$ region is blocked from the second region, each of the $2t^{th}$ region and the $2n^{th}$ region is blocked from the first region, and the third region and the $2t+1^{th}$ region communicate with the $2t^{th}$ region and the $2n^{th}$ region, respectively.

* * * * *